US005165345A

United States Patent [19]

Lewis et al.

[11] Patent Number: 5,165,345

[45] Date of Patent: * Nov. 24, 1992

[54] LITHOGRAPHIC PRINTING PLATES CONTAINING IMAGE-SUPPORT PIGMENTS AND METHODS OF PRINTING THEREWITH

[75] Inventors: Thomas E. Lewis, E. Hampstead, N.H.; Michael T. Nowak, Gardner, Mass.

[73] Assignee: Presstek, Inc., Hudson, N.H.

[ * ] Notice: The portion of the term of this patent subsequent to May 5, 2009 has been disclaimed.

[21] Appl. No.: 661,526

[22] Filed: Feb. 25, 1991

Related U.S. Application Data

[63] Continuation-in-part of Ser. No. 442,317, Nov. 28, 1989, Pat. No. 5,109,771, which is a continuation-in-part of Ser. No. 234,475, Aug. 19, 1988, Pat. No. 4,911,075.

[51] Int. Cl.[5] ..... B41C 1/10; B41N 1/00

[52] U.S. Cl. ..... 101/453; 101/467

[58] Field of Search ..... 101/467, 453, 458, 459; 346/135.1, 162, 163, 164, 335

[56] References Cited

U.S. PATENT DOCUMENTS

| | | | |
|---|---|---|---|
| 2,555,321 | 6/1951 | Dalton et al. | 204/2 |
| 3,263,604 | 8/1966 | Dalton | 101/149.2 |
| 3,411,948 | 11/1968 | Reis | 117/217 |
| 3,516,911 | 6/1970 | Hopps, Jr. | 346/135.1 X |
| 4,082,902 | 4/1978 | Suzuki et al. | 101/467 X |
| 4,617,579 | 10/1986 | Sachder et al. | 101/462 |
| 4,622,262 | 11/1986 | Cohen | 428/219 |
| 4,718,340 | 1/1988 | Love, III | 101/467 X |
| 4,991,075 | 3/1990 | Lewis et al. | 101/453 |
| 5,109,771 | 5/1992 | Lewis et al. | 101/453 |

FOREIGN PATENT DOCUMENTS

| | | |
|---|---|---|
| 0147624 | 7/1985 | European Pat. Off. . |
| 0200488 | 4/1986 | European Pat. Off. . |
| 3909753A1 | 3/1989 | Fed. Rep. of Germany . |
| 6244497 | 8/1985 | Japan . |
| 1-290527 | 5/1988 | Japan . |
| 1-258308 | 6/1988 | Japan . |
| 30786 | 1/1989 | Japan . |
| 9002044 | 3/1990 | PCT Int'l Appl. . |
| 9104154 | 4/1991 | PCT Int'l Appl. . |
| 9108108 | 6/1991 | PCT Int'l Appl. . |
| 1480081 | 9/1974 | United Kingdom . |

OTHER PUBLICATIONS

Demicheva et al., "Destruction of Superconductivity of Oxidized Polypropylene with Critical Current", 51 *Letters to ZhETF* 222 (1990).

Demicheva et al., "Anomalously High Electroconduction and Magnetism in Silicon Rubber Films", 32 *High Molecular Compositions* 3 (1990).

*Memory Switches Based on* $MnO_{2-x}$ *Thin Films*, NASA Tech Brief, Dec. 1989.

*Primary Examiner*—Clifford D. Crowder

*Attorney, Agent, or Firm*—Cesari and McKenna

[57] ABSTRACT

A lithographic printing plate that is transformable by spark-discharge techniques so as to change its affinity for ink. The plate features a layered structure including an ink-receptive substrate, a conductive layer and an ink-repellent coating. The ink-repellent coating contains a dispersion of image-support pigments that promote straight-line travel of the spark to the surface of the plate, thereby promoting accurate imaging.

26 Claims, 4 Drawing Sheets

LITHOGRAPHIC PRINTING PLATES CONTAINING IMAGE-SUPPORT PIGMENTS AND METHODS OF PRINTING THEREWITH

RELATED APPLICATION

This is a continuation-in-part of Ser. No. 07/442,317, filed Nov. 28, 1989, now U.S. Pat. No. 5,109,771, which is itself a continuation-in-part of Ser. No. 07/234,475, filed Aug. 19, 1988, now U.S. Pat. No. 4,911,075.

FIELD OF THE INVENTION

This invention relates to offset lithography. It relates more specifically to improved lithography plates and method and apparatus for imaging these plates.

BACKGROUND OF THE INVENTION

There are a variety of known ways to print hard copy in black and white and in color. The traditional techniques include letterpress printing, rotogravure printing and offset printing. These conventional printing processes produce high quality copies. However, when only a limited number of copies are required, the copies are relatively expensive. In the case of letterpress and gravure printing, the major expense results from the fact that the image is to be cut or etched into the plate using expensive photographic masking and chemical etching techniques. Plates are also required in offset lithography. However, the plates are in the form of mats or films which are relatively inexpensive to make. The image is present on the plate or mat as hydrophilic and hydrophobic and ink-receptive surface areas. In wet lithography, water and then ink are applied to the surface of the plate. Water tends to adhere to the hydrophilic or water-receptive areas of the plate creating a thin film of water there which does not accept ink. The ink does adhere to the hydrophobic areas of the plate and those inked areas, usually corresponding to the printed areas of the original document, are transferred to a relatively soft blanket cylinder and, from there, to the paper or other recording medium brought into contact with the surface of the blanket cylinder by an impression cylinder.

Most conventional offset plates are also produced photographically. In a typical negative-working, subtractive process, the original document is photographed to produce a photographic negative. The negative is placed on an aluminum plate having a water-receptive oxide surface that is coated with a photopolymer. Upon being exposed to light through the negative, the areas of the coating that received light (corresponding to the dark or printed areas of the original) cure to a durable oleophilic or ink-receptive state. The plate is then subjected to a developing process which removes the non-cured areas of the coating that did not receive light (corresponding to the light or background areas of the original). The resultant plate now carries a positive or direct image of the original document.

If a press is to print in more than one color, a separate printing plate corresponding to each color is required, each of which is usually made photographically as aforesaid. In addition to preparing the appropriate plates for the different colors, the plates must be mounted properly on the print cylinders in the press and the angular positions of the cylinders coordinated so that the color components printed by the different cylinders will be in register on the printed copies.

The development of lasers has simplified the production of lithographic plates to some extent. Instead of applying the original image photographically to the photoresist-coated printing plate as above, an original document or picture is scanned line-by-line by an optical scanner which develops strings of picture signals, one for each color. These signals are then used to control a laser plotter that writes on and thus exposes the photoresist coating on the lithographic plate to cure the coating in those areas which receive lights. That plate is then developed in the usual way by removing the unexposed areas of the coating to create a direct image on the plate for that color. Thus, it is still necessary to chemically etch each plate in order to create an image on that plate.

There have been some attempts to use more powerful lasers to write images on lithographic plates. However, the use of such lasers for this purpose has not been entirely satisfactory because the photoresist coating on the plate must be compatible with the particular laser, which limits the choice of coating materials. Also, the pulsing frequencies of some lasers used for this purpose are so low that the time required to produce a halftone image on the plate is unacceptably long.

There have also been some attempts to use scanning E-beam apparatus to etch away the surface coatings on plates used for printing. However, such machines are very expensive. In addition, they require the workpiece, i.e. the plate, be maintained in a complete vacuum, making such apparatus impractical for day-to-day use in a printing facility.

An image has also been applied to a lithographic plate by electro-erosion. The type of plate suitable for imaging in this fashion in U.S. Pat. No. 4,596,733, has an oleophilic plastic substrate, e.g. Mylar plastic film, having a thin coating of aluminum metal with an overcoating of conductive graphite which acts as a lubricant and protects the aluminum coating against scratching. A stylus electrode in contact with the graphite surface coating is caused to move across the surface of the plate and is pulsed in accordance with incoming picture signals. The resultant current flow between the electrode and the thin metal coating is by design large enough to erode away the thin metal coating and the overlying conductive graphite surface coating thereby exposing the underlying ink-receptive plastic substrate on the areas of the plate corresponding to the printed portions of the original document. This method of making lithographic plates is disadvantaged in that the described electro-erosion process only works on plates whose conductive surface coatings are very thin; furthermore the stylus electrode which contacts the surface of the plate sometimes scratches the plate. This degrades the image being written onto the plate because the scratches constitute inadvertent or unwanted image areas on the plate which print unwanted marks on the copies.

Finally, we are aware of a press system, only recently developed, which images a lithographic plate while the plate is actually mounted on the print cylinder in the press. The cylindrical surface of the plate, treated to render it either oleophilic or hydrophilic, is written on by an ink jetter arranged to scan over the surface of the plate. The ink jetter is controlled so as to deposit on the plate surface a thermoplastic image-forming resin or material which has a desired affinity for the printing ink being used to print the copies. For example, the image-forming material may be attractive to the printing ink so that the ink adheres to the plate in the areas thereof where the image-forming material is present and phobic to the "wash" used in the press to prevent inking of the background areas of the image on the plate.

While that prior system may be satisfactory for some applications, it is not always possible to provide thermoplastic image-forming material that is suitable for jetting and also has the desired affinity (philic or phobic) for all of the inks commonly used for making lithographic copies. Also, ink jet printers are generally unable to produce small enough ink dots to allow the production of smooth continuous tones on the printed copies, i.e. the resolution is not high enough.

Thus, although there have been all the aforesaid efforts to improve different aspects of lithographic plate production and offset printing, these efforts have not reached full fruition primarily because of the limited number of different plate constructions available and the limited number of different techniques for practically and economically imaging those known plates. Accordingly, it would be highly desirable if new and different lithographic plates became available which could be imaged by writing apparatus able to respond to incoming digital data so as to apply a positive or negative image directly to the plate in such a way as to avoid the need of subsequent processing of the plate to develop or fix that image.

SUMMARY OF THE INVENTION

Accordingly, the present invention aims to provide various lithographic plate constructions which can be imaged or written on to form a positive or negative image therein.

Another object is to provide such plates which can be used in a wet or dry press with a variety of different printing inks.

Another object is to provide low cost lithographic plates which can be imaged electrically.

A further object is to provide an improved method for imaging lithographic printing plates.

Another object of the invention is to provide a method of imaging lithographic plates which can be practiced while the plate is mounted in a press.

Still another object of the invention is to provide a method for writing both positive and negative on background images on lithographic plates.

Still another object of the invention is to provide such a method which can be used to apply images to a variety of different kinds of lithographic plates.

A further object of the invention is to provide a method of producing on lithographic plates half tone images with variable dot sizes.

A further object of the invention is to provide improved apparatus for imaging lithographic plates.

Another object of the invention is to provide apparatus of this type which applies the images to the plates efficiently and with a minimum consumption of power.

Still another object of the invention is to provide such apparatus which lends itself to control by incoming digital data representing an original document or picture.

Other objects will, in part, be obvious and will, in part, appear hereinafter. The invention accordingly comprises an article of manufacture possessing the features and properties exemplified in the constructions described herein and the several steps and the relation of one or more of such steps with respect to the others and the apparatus embodying the features of construction, combination of elements and the arrangement of parts which are adapted to effect such steps, all as exemplified in the following detailed description, and the scope of the invention will be indicated in the claims.

In accordance with the present invention, images are applied to a lithographic printing plate by altering the plate surface characteristics at selected points or areas of the plate using a non-contacting writing head which scans over the surface of the plate and is controlled by incoming picture signals corresponding to the original document or picture being copied. The writing head utilizes a precisely positioned high voltage spark discharge electrode to create on the surface of the plate an intense-heat spark zone as well as a corona zone in a circular region surrounding the spark zone. In response to the incoming picture signals and ancillary data keyed in by the operator such as dot size, screen angle, screen mesh, etc. and merged with the picture signals, high voltage pulses having precisely controlled voltage and current profiles are applied to the electrode to produce precisely positioned and defined spark/corona discharges to the plate which etch, erode or otherwise transform selected points or areas of the plate surface to render them either receptive or non-receptive to the printing ink that will be applied to the plate to make the printed copies.

Lithographic plates are made ink receptive or oleophobic initially by providing them with surface areas consisting of unoxidized metals or plastic materials to which oil and rubber based inks adhere readily. On the other hand, plates are made water receptive or hydrophilic initially in one of three ways. One plate embodiment is provided with a plated metal surface, e.g. of chrome, whose topography or character is such that it is wetted by surface tension. A second plate has a surface consisting of a metal oxide, e.g. aluminum oxide, which hydrates with water. The third plate construction is provided with a polar plastic surface which is also roughened to render it hydrophilic. As will be seen later, certain ones of these plate embodiments are suitable for wet printing, others are better suited for dry printing. Also, different ones of these plate constructions are preferred for direct writing; others are preferred for indirect or background writing.

The present apparatus can write images on all of these different lithographic plates having either ink receptive or water receptive surfaces. In other words, if the plate surface is hydrophilic initially, our apparatus will write a positive or direct image on the plate by rendering oleophilic the points or areas of the plate surface corresponding to the printed portion of the original document. On the other hand, if the plate surface is oleophilic initially, the apparatus will apply a background or negative image to the plate surface by rendering hydrophilic or oleophobic the points or areas of that surface corresponding to the background or non-printed portion of the original document. Direct or positive writing is usually preferred since the amount of plate surface area that has to be written on or converted is less because most documents have less printed areas than non-printed areas.

The plate imaging apparatus incorporating our invention is preferably implemented as a scanner or plotter whose writing head consists of one or more spark discharge electrodes. The electrode (or electrodes) is positioned over the working surface of the lithographic plate and moved relative to the plate so as to collectively scan the plate surface. Each electrode is controlled by an incoming stream of picture signals which is an electronic representation of an original document or picture. The signals can originate from any suitable source such as an optical scanner, a disk or tape reader, a computer, etc. These signals are formatted so that the apparatus' spark discharge electrode or electrodes write a positive or negative image onto the surface of the lithographic plate that corresponds to the original document.

If the lithographic plates being imaged by our apparatus are flat, then the spark discharge electrode or electrodes may be incorporated into a flat bed scanner or plotter. Usually, however, such plates are designed to be mounted to a print cylinder. Accordingly, for most applications, the spark discharge writing head is incorporated into a so-called drum scanner or plotter with the lithographic plate being mounted to the cylindrical surface of the drum. Actually, as we shall see, our invention can be practiced on a lithographic plate already mounted in a press to apply an image to that plate in situ. In this application, then, the print cylinder itself constitutes the drum component of the scanner or plotter.

To achieve the requisite relative motion between the spark discharge writing head and the cylindrical plate, the plate can be rotated about its axis and the head moved parallel to the rotation axis so that the plate is scanned circumferentially with the image on the plate "growing" in the axial direction. Alternatively, the writing head can move parallel to the drum axis and after each pass of the head, the drum can be incremented angularly so that the image on the plate grows circumferentially. In both cases, after a complete scan by the head, an image corresponding to the original document or picture will have been applied to the surface of the printing plate.

As each electrode traverses the plate, it is supported on a cushion of air so that it is maintained at a very small fixed distance above the plate surface and cannot scratch that surface. In response to the incoming picture signals, which usually represent a half tone or screened image, each electrode is pulsed or not pulsed at selected points in the scan depending upon whether, according to the incoming data, the electrode is to write or not write at these locations. Each time the electrode is pulsed, a high voltage spark discharge occurs between the electrode tip and the particular point on the plate opposite the tip. The heat from that spark discharge and the accompanying corona field surrounding the spark etches or otherwise transforms the surface of the plate in a controllable fashion to produce an image forming spot or dot on the plate surface which is precisely defined in terms of shape and depth of penetration into the plate.

Preferably the tip of each electrode is pointed to obtain close control over the definition of the spot on the plate that is affected by the spark discharge from that electrode. Indeed, the pulse duration, current or voltage controlling the discharge may be varied to produce a variable dot on the plate. Also, the polarity of the voltage applied to the electrode may be made positive or negative depending upon the nature of the plate surface to be affected by the writing, i.e. depending upon whether ions need to be pulled from or repelled to the surface of the plate at each image point in order to transform the surface at that point to distinguish it imagewise from the remainder of the plate surface, e.g. to render it oleophilic in the case of direct writing on a plate whose surface is hydrophilic. In this way, image spots can be written onto the plate surface that have diameters in the order of 0.005 inch all the way down to 0.0001 inch.

After a complete scan of the plate, then, the apparatus will have applied a complete screened image to the plate in the form of a multiplicity of surface spots or dots which are different in their affinity for ink from the portions of the plate surface not exposed to the spark discharges from the scanning electrode.

Thus, using our method and apparatus, high quality images can be applied to our special lithographic plates which have a variety of different plate surfaces suitable for either dry or wet offset printing. In all cases, the image is applied to the plate relatively quickly and efficiently and in a precisely controlled manner so that the image on the plate is an accurate representation of the printing on the original document. Actually using our technique, a lithographic plate can be imaged while it is mounted in its press thereby reducing set up time considerably. An even greater reduction in set up time results if the invention is practiced on plates mounted in a color press because correct color registration between the plates on the various print cylinders can be accomplished electronically rather than manually by controlling the timings of the input data applied to the electrodes that control the writing of the images on the corresponding plates. As a consequence of the forgoing combination of features, our method and apparatus for applying images to lithographic plates and the-plates themselves should receive wide acceptance in the printing industry.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENTS

Figure 1:
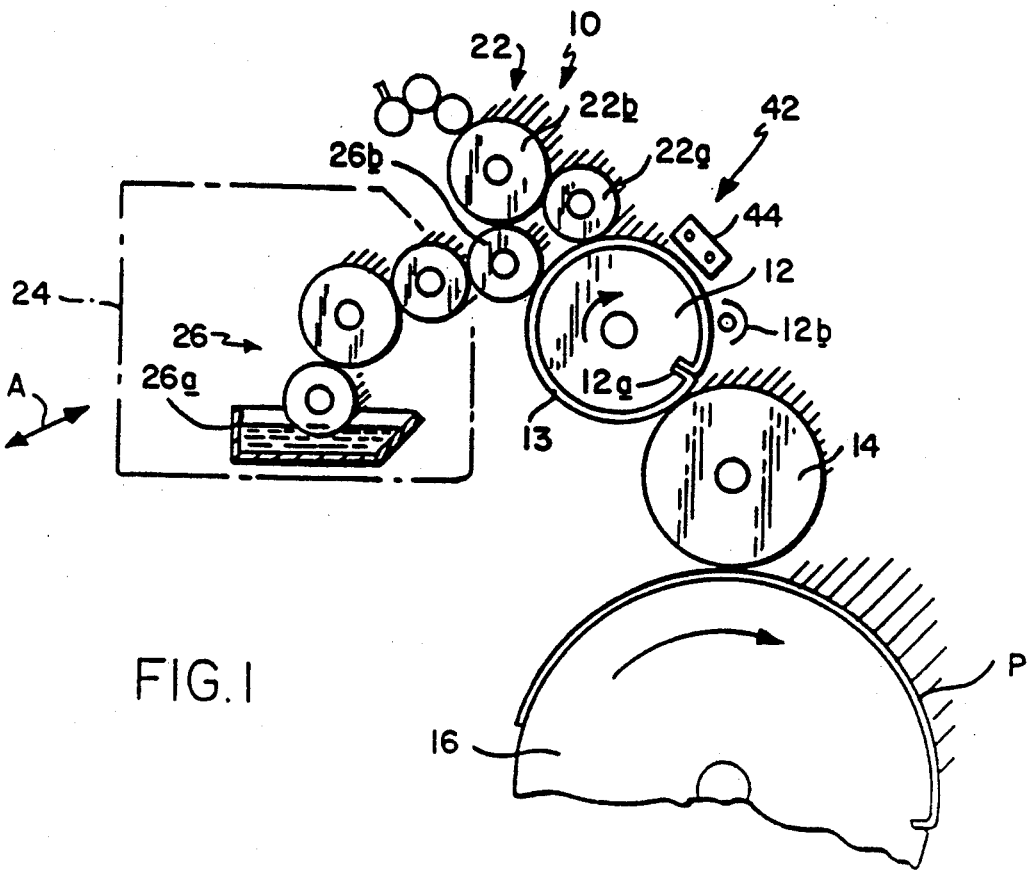
FIG. 1 is a diagrammatic view of an offset press incorporating a lithographic printing plate made in accordance with this invention.

Refer first to FIG. 1 of the drawings which shows a more or less conventional offset press shown generally at 10 which can print copies using lithographic plates made in accordance with this invention.

Press 10 includes a print cylinder or drum 12 around which is wrapped a lithographic plate 13 whose opposite edge margins are secured to the plate by a conventional clamping mechanism 12A incorporated into cylinder 12. Cylinder 12, or more precisely the plate 13 thereon, contacts the surface of a blanket cylinder 14 which, in turn, rotates in contact with a large diameter impression cylinder 16. The paper sheet P to be printed on is mounted to the surface of cylinder 16 so that it passes through the nip between cylinders 14 and 16 before being discharged to the exit end of the press 10. Ink for inking plate 13 is delivered by an ink train 22, the lowermost roll 22*a* of which is in rolling engagement with plate 13 when press 10 is printing. As is customary in presses of this type, the various cylinders are all geared together so that they are driven in unison by a single drive motor.

The illustrated press 10 is capable of wet as well as dry printing. Accordingly, it includes a conventional dampening or water fountain assembly 24 which is movable toward and away from drum 12 in the directions indicated by arrow A in FIG. 1 between active and inactive positions. Assembly 24 includes a conventional water train shown generally at 26 which conveys water from a tray 26*a* to a roller 26*b* which, when the dampening assembly is active, is in rolling engagement with plate 13 and the intermediate roller 22*b* of ink train 22 as shown in phantom in FIG. 1.

When press 10 is operating in its dry printing mode, the dampening assembly 24 is inactive so that roller 26*b* is retracted from roller 22*b* and the plate as shown in solid lines in FIG. 1 and no water is applied to the plate. The lithographic plate on cylinder 12 in this case is designed for such dry printing. See for example plate 138 in FIG. 4D. It has a surface which is oleophobic or non-receptive to ink except in those areas that have been written on or imaged to make them oleophilic or receptive to ink. As the cylinder 12 rotates, the plate is contacted by the ink- coated roller 22*a* of ink train 22. The areas of the plate surface that have been written on and thus made oleophilic pick up ink from roller 22*a*. Those areas of the plate surface not written on receive no ink. Thus, after one revolution of cylinder 12, the image written on the plate will have been inked or developed. That image is then transferred to the blanket cylinder 14 and finally, to the paper sheet P which is pressed into contact with the blanket cylinder.

Figure 4A:
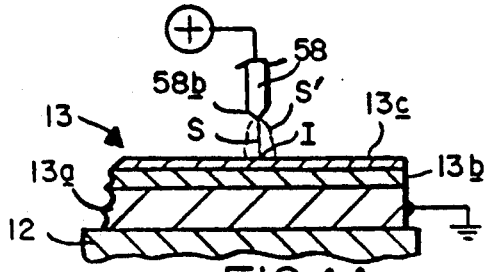
FIGS. 4A to 4G are enlarged sectional views showing imaged or unimaged lithographic plates incorporating our invention.

When press 10 is operating in its wet printing mode, the dampening assembly 24 is active so that the water roller 26*b* contacts ink roller 22*b* and the surface of the plate 13 as shown in phantom in FIG. 1. Plate 13, which is described in more detail in connection with FIG. 4A, is intended for wet printing. It has a surface which is hydrophilic except in the areas thereof which have been written on to make them oleophilic. Those areas, which correspond to the printed areas of the original document, shun water. In this mode of operation, as the cylinder 12 rotates (clockwise in FIG. 1), water and ink are presented to the surface of plate 13 by the rolls 26*b* and 22*a*, respectively. The water adheres to the hydrophilic areas of that surface corresponding to the background of the original document and those areas, being coated with water, do not pick up ink from roller 22*a*. On the other hand, the oleophilic areas of the plate surface which have not been wetted by roller 26, pick up ink from roller 22*a*, again forming an inked image on the surface of the plate. As before, that image is transferred via blanket roller 14 to the paper sheet P on cylinder 16.

Figure 2:
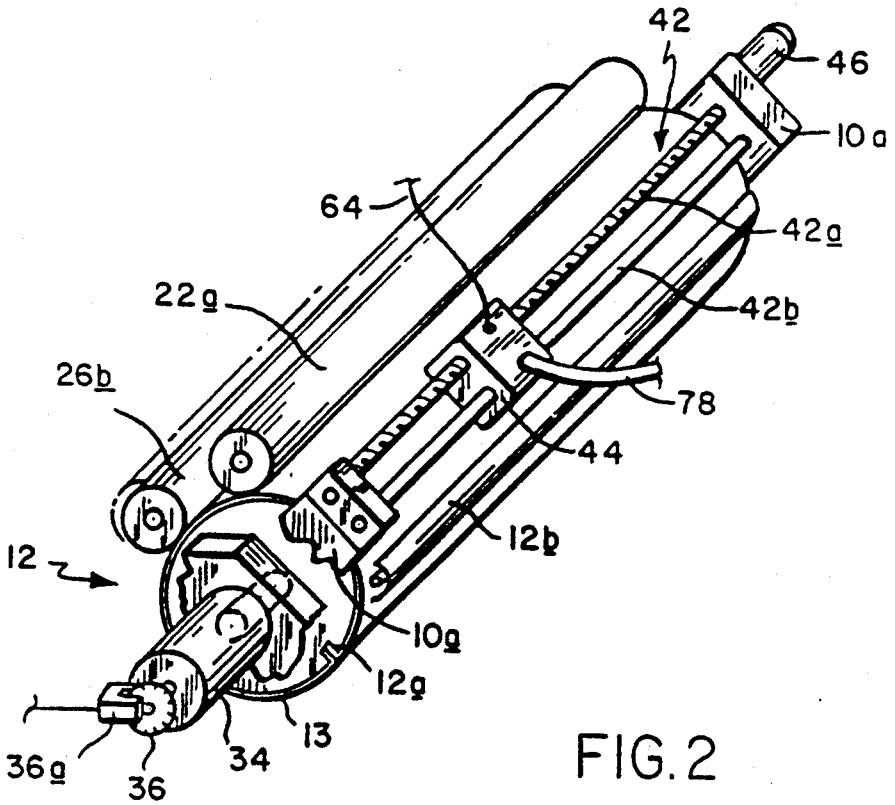
FIG. 2 is an isometric view on a larger scale showing in greater detail the print cylinder portion of the FIG. 1 press.

While the image to be applied to the lithographic plate 13 can be written onto the plate while the plate is "off press", our invention lends itself to imaging the plate when the plate is mounted on the print cylinder 12 and the apparatus for accomplishing this will now be described with reference to FIG. 2. As shown in FIG. 2, the print cylinder 12 is rotatively supported by the press frame 10*a* and rotated by a standard electric motor 34 or other conventional means. The angular position of cylinder 12 is monitored by conventional means such as a shaft encoder 36 that rotates with the motor armature and associated detector 36*a*. If higher resolution is needed, the angular position of the large diameter impression cylinder 16 may be monitored by a suitable magnetic detector that detects the teeth of the circumferential drive gear on that cylinder which gear meshes with a similar gear on the print cylinder to rotate that cylinder.

Also supported on frame 10*a* adjacent to cylinder 12 is a writing head assembly shown generally at 42. This assembly comprises a lead screw 42*a* whose opposite ends are rotatively supported in the press frame 10*a*, which frame also supports the opposite ends of a guide bar 42*b* spaced parallel to lead screw 42*a*. Mounted for movement along the lead screw and guide bar is a carriage 44. When the lead screw is rotated by a step motor 46, carriage 44 is moved axially with respect to print cylinder 12.

The cylinder drive motor 34 and step motor 46 are operated in synchronism by a controller 50 (FIG. 3), which also receives signals from detector 36*a*, so that as the drum rotates, the carriage 44 moves axially along the drum with the controller "knowing" the instantaneous relative position of the carriage and cylinder at any given moment. The control circuitry required to accomplish this is already very well known in the scanner and plotter art.

Figure 3:
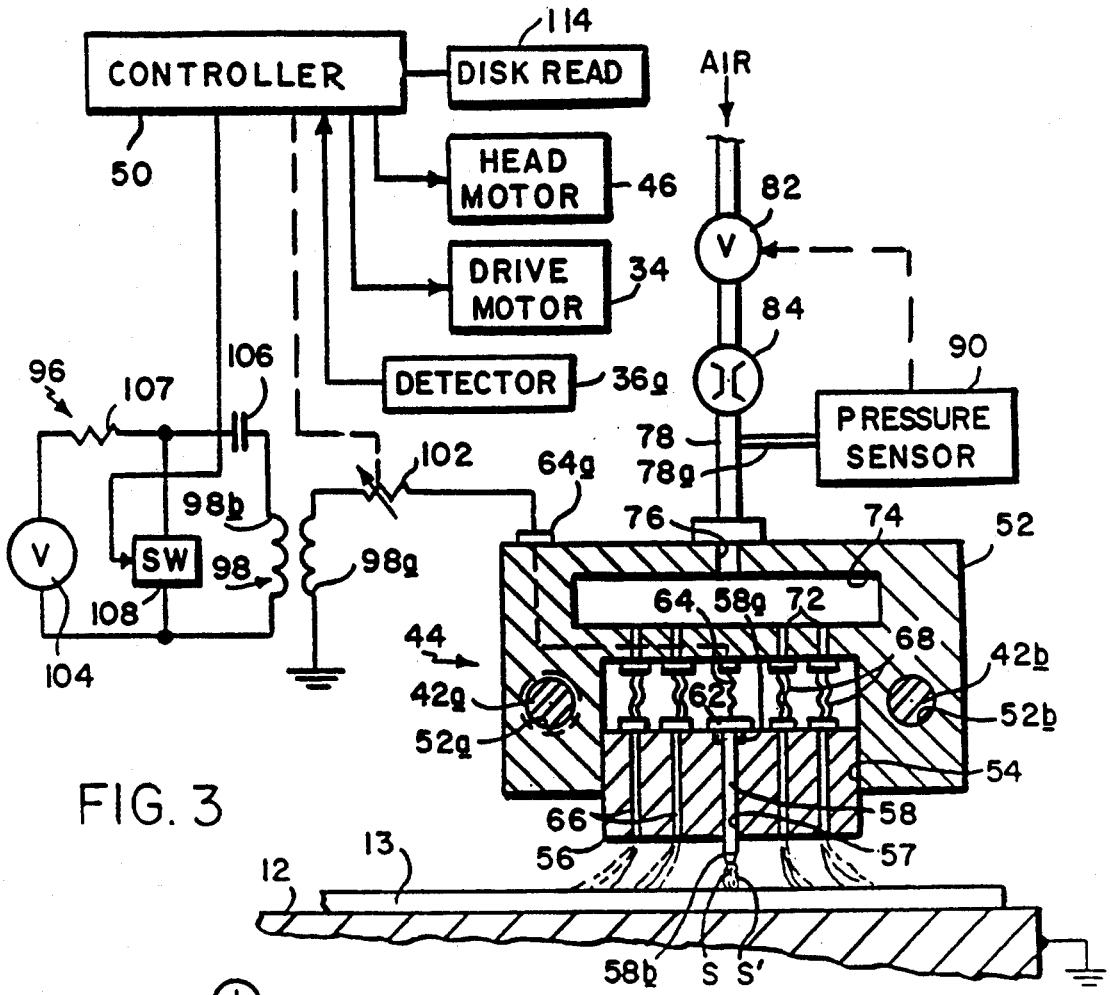
FIG. 3 is a sectional view taken along line 3—3 of FIG. 2 on a larger scale showing the writing head that applies an image to the surface of the FIG. 2 print cylinder, with the associated electrical components being represented in a block diagram.

Refer now to FIG. 3 which depicts an illustrative embodiment of carriage 44. It includes a block 52 having a threaded opening 52*a* for threadedly receiving the lead screw 42*a* and a second parallel opening 52*b* for slidably receiving the guide rod 42*b*. A bore or recess 54 extends in from the underside of block 52 for slidably receiving a discoid writing head 57 made of a suitable rigid electrical insulating material. An axial passage 57 extends through head 56 for snugly receiving a wire electrode 58 whose diameter has been exaggerated for clarity. The upper end 58*a* of the wire electrode is received and anchored in a socket 62 mounted to the top of head 56 and the lower end 58*b* of the electrode 58 is preferably pointed as shown in FIG. 3. Electrode 58 is made of an electrically conductive metal, such as thoriated tungsten, capable of withstanding very high temperatures. An insulated conductor 64 connects socket 62 to a terminal 64*a* at the top of block 52. If the carriage 44 has more than one electrode 58, similar connections are made to those electrodes so that a plurality of points on the plate 13 can be imaged simultaneously by assembly 42.

Also formed in head 56 are a plurality of small air passages 66. These passages are distributed around electrode 58 and the upper ends of the passages are connected by way of flexible tubes or hoses 68 to a corresponding plurality of vertical passages 72. These passages extend from the inner wall of block bore 54 to an air manifold 74 inside the block which has an inlet passage 76 extending to the top of the block. Passage 76 is connected by a pipe 78 to a source of pressurized air. In the line from the air source is an adjustable valve 82 and a flow restrictor 84. Also, a branch line 78*a* leading from pipe 78 downstream from restrictor 84 connects to a pressure sensor 90 which produces an output for controlling the setting of valve 82.

When the carriage 44 is positioned opposite plate 13 as shown in FIG. 3 and air is supplied to its manifold 74, the air issues from the lower ends of passages 66 with sufficient force to support the head above the plate surface. The back pressure in passages 66 and manifold 74 varies directly with the spacing of head 56 from the surface of plate 13 and this back pressure is sensed by pressure sensor 90. The sensor controls valve 82 to adjust the air flow to head 56 so that the tip 58*b* of the needle electrode 58 is maintained at a precisely controlled very small spacing, e.g. 0.0001 inch, above the surface of plate 13 as the carriage 44 scans along the surface of the plate.

Still referring to FIG. 3, the writing head 56, and particularly the pulsing of its electrode 58, is controlled by a pulse circuit 96. This circuit comprises a transformer 98 whose secondary winding 98*a* is connected at one-end by way of a variable resistor 102 to terminal 64*a* which, as noted previously, is connected electrically to electrode 58. The opposite end of winding 98*a* is connected to electrical ground. The transformer primary winding 98*b* is connected to a DC voltage source 104 that supplies a voltage in the order of 1000 volts. The transformer primary circuit includes a large capacitor 106 and a resistor 107 in series. The capacitor is maintained at full voltage by the resistor 107. An electronic switch 108 is connected in shunt with winding 98*b* and the capacitor. This switch is controlled by switching signals received from controller 50.

When an image is being written on plate 13, the press 10 is operated in a non-print or imaging mode with both the ink and water rollers 22*a* and 26*b* being disengaged from cylinder 12. The imaging of plate 13 in press 10 is controlled by controller 50 which, as noted previously, also controls the rotation of cylinder 12 and the scanning of the plate by carriage assembly 42. The signals for imaging plate 13 are applied to controller 50 by a conventional source of picture signals such as a disk reader 114. The controller 50 synchronizes the image data from disk reader 114 with the control signals that control rotation of cylinder 12 and movement of carriage 44 so that when the electrode 58 is positioned over uniformly spaced image points on the plate 13, switch 108 is either closed or not closed depending upon whether that particular point is to be written on or not written on.

If that point is not to be written on, i.e. it corresponds to a location in the background of the original document, the electrode is not pulsed and proceeds to the next image point. On the other hand, if that point in the plate does correspond to a location in the printed area of the original document, switch 108 is closed. The closing of that switch discharges capacitor 106 so that a precisely shaped, i.e. squarewave, high voltage pulse, i.e. 1000 volts, of only about one microsecond duration is applied to transformer 98. The transformer applies a stepped up pulse of about 3000 volts to electrode 58 causing a spark discharge S between the electrode tip 58*b* and plate 13. That sparks and the accompanying corona field S' surrounding the spark zone etches or transforms the surface of the plate at the point thereon directly opposite the electrode tip 58*b* to render that point either receptive or non-receptive to ink, depending upon the type of surface on the plate.

The transformations that do occur with our different lithographic plate constructions will be described in more detail later. Suffice it to say at this point, that resistor 102 is adjusted for the different plate embodiments to produce a spark discharge that writes a clearly defined image spot on the plate surface which is in the order of 0.005 to 0.0001 inch in diameter. That resistor 102 may be varied manually or automatically via controller 50 to produce dots of variable size. Dot size may also be varied by varying the voltage and/or duration of the pulses that produce the spark discharges. Means for doing this are quite well known in the art. If the electrode has a pointed end 58*b* as shown and the gap between tip 58*b* and the plate is made very small, i.e. 0.001 inch, the spark discharge is focused so that image spots as small as 0.0001 inch or even less can be formed while keeping voltaqe requirements to a minimum. The polarity of the voltage applied to the electrode may be positive or negative although preferably, the polarity is selected according to whether ions need to be pulled from or repelled to the plate surface to effect the desired surface transformations on the various plates to be described.

As the electrode 58 is scanned across the plate surface, it can be pulsed at a maximum rate of about 500,000 pulses/sec. However, a more typical rate is 25,000 pulses/sec. Thus, a broad range of dot densities can be achieved, e.g. 2,000 dots/inch to 50 dots/inch. The dots can be printed side-by-side or they may be made to overlap so that substantially 100% of the surface area of the plate can be imaged. Thus, in response to the incoming data, an image corresponding to the original document builds up on the plate surface constituted by the points or spots on the plate surface that have been etched or transformed by the spark discharge S, as compared with the areas of the plate surface that have not been so affected by the spark discharge.

In the case of axial scanning, then, after one revolution of print cylinder 12, a complete image will have been applied to plate 13. The press 10 can then be operated in its printing mode by moving the ink roller 22*a* to its inking position shown in solid lines in FIG. 1, and, in the case of wet printing, by also shifting the water fountain roller 26*b* to its dotted line position shown in FIG. 1. As the plate rotates, ink will adhere only to the image points written onto the plate that correspond to the printed portion of the original document. That ink image will then be transferred in the usual way via blanket cylinder 14 to the paper sheet P mounted to cylinder 16.

Forming the image on the plate 13 while the plate is on the cylinder 12 provides a number of advantages, the most important of which is the significant decrease in the preparation and set up time, particularly if the invention is incorporated into a multi-color press. Such a press includes a plurality of sections similar to press 10 described herein, one for each color being printed. Whereas normally the print cylinders in the different press sections after the first are adjusted axially and in phase so that the different color images printed by the lithographic plates in the various press sections will appear in register on the printed copies, it is apparent from the foregoing that, since the images are applied to the plates 13 while they are mounted in the press sections, such print registration can be accomplished electronically in the present case.

More particularly, in a multicolor press, incorporating a plurality of press sections similar to press 10, the controller 50 would adjust the timings of the picture signals controlling the writing of the images at the second and subsequent printing sections to write the image on the lithographic plate 13 in each such station with an axial and/or angular offset that compensates for any misregistration with respect to the image on the first plate 13 in the press. In other words, instead of achieving such registration by repositioning the print cylinders or plates, the registration errors are accounted for when writing the images on the plates. Thus once imaged, the plates will automatically print in perfect register on paper sheet P.

Refer now to FIGS. 4A to 4F which illustrate various lithographic plate embodiments which are capable of being imaged by the apparatus depicted in FIGS. 1 to 3. In FIG. 4A, the plate 13 mounted to the print cylinder 12 comprises a steel base or substrate layer 13*a* having a flash coating 13*b* of copper metal which is, in turn, plated over by a thin layer 13*c* of chrome metal. As described in detail in U.S. Pat. No. 4,596,760, the plating process produces a surface topography which is hydrophilic. Therefore, plate 13 is a preferred one for use in a dampening-type offset press.

During a writing operation on plate 13 as described above, voltage pulses are applied to electrode 58 so that spark discharges S occur between the electrode tip 58*b* and the surface layer 13*c* of plate 13. Each spark discharge, coupled with the accompanying corona field S' surrounding the spark zone, melts the surface of layer 13*c* at the imaging point I on that surface directly opposite tip 58*b*. Such melting suffices to fill or close the capillaries at that point on the surface so that water no longer tends to adhere to that surface area. Accordingly, when plate 13 is imaged in this fashion, a multiplicity of non-water-receptive spots or dots I are formed on the otherwise hydrophilic plate surface, which spots or dots represent the printed portion of the original document being copied.

When press 10 is operated in its wet printing mode, i.e. with dampening assembly 24 in its position shown in phantom in FIG. 1, the water from the dampening roll 26*b* adheres only to the surface areas of plate 13 that were not subjected to the spark discharges from electrode 58 during the imaging operation. On the other hand, the ink from the ink roll 22*a* does adhere to those plate surface areas written on, but does not adhere to the surface areas of the plate where the water or wash solution is present. When printing, the ink adhering to the plate, which forms a direct image of the original document, is transferred via the blanket cylinder 14 to the paper sheet P on cylinder 16. While the polarity of the voltage applied to electrode 58 during the imaging process described above can be positive or negative, we have found that for imaging a plate with a bare chrome surface such as the one in FIG. 4A, a positive polarity is preferred because it enables better control over the formation of the spots or dots on the surface of the plate.

Figure 4B:
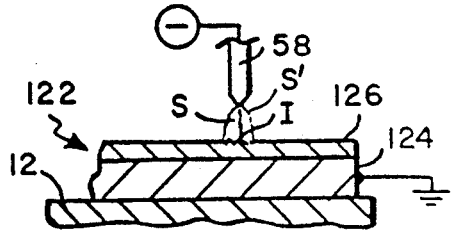

FIG. 4B illustrates another plate embodiment which is written on directly and used in a dampening-type press. This plate, shown generally at 122 in FIG. 4B, has a substrate 124 made of a metal such as aluminum which has a structured oxide surface layer 126. This surface layer may be produced by any one of a number of known chemical treatments, in some cases assisted by the use of fine abrasives to roughen the plate surface. The controlled oxidation of the plate surface is commonly called anodizing while the surface structure of the plate is referred to as grain or graining. As part of the chemical treatment, modifiers such as silicates, phosphates, etc. are used to stabilize the hydrophilic character of the plate surface and to promote both adhesion and the stability of the photosensitive layer(s) that are coated on the plates.

The aluminum oxide on the surface of the plate is not the crystalline structure associated with corundum or a laser ruby (both are aluminum oxide crystals), and shows considerable interaction with water to form hydrates of the form $Al_2O_3H_2O$. This interaction with contributions from silicate, phosphate, etc. modifiers is the source of the hydrophilic nature of the plate surface. Formation of hydrates is also a problem when the process proceeds unchecked. Eventually a solid hydrate mass forms that effectively plugs and eliminates the structure of the plate surface. Ability to effectively hold a thin film of water required to produce nonimage areas is thus lost which renders the plate useless. Most plates are supplied with photosensitive layers in place that protect the plate surfaces until the time the plates are exposed and developed. At this point, the plates are either immediately used or stored for use at a latter time. If the plates are stored, they are coated with a water soluble polymer to protect hydrophilic surfaces. This is the process usually referred to as gumming in the trade. Plates that are supplied without photosensitive layers are usually treated in a similar manner.

The loss of hydrophilic character during storage or extended interruptions while the plate is being used is generally referred to as oxidation in the trade. Depending on the amount of structuring and chemical modifiers used, there is a considerable variation in plate sensitivity to excessive hydration.

When the plate 122 is subjected to the spark discharge from electrode 58, the heat from the spark S and associated corona S' around the spark zone renders oleophilic or ink receptive a precisely defined image point I opposite the electrode tip 58*b*.

The behavior of the imaged aluminum plate suggests that the image points I are the result of combined partial processes. It is believed that dehydration, some formation of fused aluminum oxide, and the melting and transport to the surface of aluminum metal occur. The combined effects of the three processes, we suppose, reduce the hydrophilic character of the plate surface at the image point. Aluminum is chemically reactive with the result that the metal is always found with a thin oxide coating regardless of how smooth or bright the metal appears. This oxide coating does not exhibit a hydrophilic character, which agrees with our observation that an imaged aluminum-based plate can be stored in air more than 24 hours without the loss of an image. In water, aluminum can react rapidly under both basic and acidic conditions including several electrochemical reactions. The mildly acidic fountain solutions used in presses are believed to have this effect on the thin films of aluminum exposed during imaging resulting in their removal.

Because of the above-mentioned affinity of the nonimaged oxide surface areas of the plate for water, protection of the just-imaged plate 122 requires that the plate surface be shielded from contact with water or water-based materials. This may be done by applying ink to the plate without the use of a dampening or fountain solution, i.e. with water roll 26*b* disengaged in FIG. 1. This results in the entire plate surface being coated with a layer of ink. Dampening water is then applied (i.e. the water roll 26*b* is engaged) to the plate. Those areas of the plate that were not imaged acquire a thin film of water that dislodges the overlying ink allowing its removal from the plate. The plate areas that were imaged do not acquire a thin film of water with the result that the ink remains in place.

The images generated on a chrome plate with an oxide surface coating show a similar sensitivity to water contact preceding ink contact. However, after the ink application step, the images on a chrome plate are more stable and the plate can be run without additional steps to preserve the image.

The ink remaining on the image points I is quite fragile and must be left to dry or set so that the ink becomes more durable. Alternatively, a standard ink which cures or sets in response to ultraviolet light may be used with plate 122. In this event, a standard ultraviolet lamp 126 may be mounted adjacent to print cylinder 12 as depicted in FIGS. 1 and 2 to cure the ink. The lamp 126 should extend the full length of cylinder 12 and be supported by frame members 10*a* close to the surface of cylinder 12 or, more particularly, the lithographic plate thereon.

We have found that imaging a plate such as plate 122 having an oxide surface coating is optimized if a negative voltage is applied to the imaging electrode 58. This is because the positive ions produced upon heating the plate at each image point migrate well in the high intensity current flow of the spark discharge and will move toward the negative electrode.

Figure 4C:
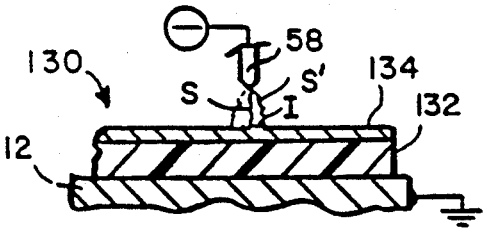

FIG. 4C shows a plate embodiment 130 suitable for direct imaging in a press without dampening. Plate 130 comprises a substrate 132 made of a conductive metal such as aluminum or steel. The substrate carries a thin coating 134 of a highly oleophobic material such as a fluoropolymer or silicone. One suitable coating material is an addition-cured release coating marketed by Dow Corning under its designation SYL-OFF 7044. Plate 130 is written on or imaged by decomposing the surface of coating 134 using spark discharges from electrode 58. The heat from the spark and associated corona decompose the silicone coating into silicon dioxide, carbon dioxide, and water. Hydrocarbon fragments in trace amounts are also possible depending on the chemistry of the silicone polymers used. Silicone resins do not have carbon in their backbones which means various polar structures such as C—OH are not formed. Silanols, which are Si—OH structures are possible structures, but these are reactive which means they react to form other, stable structures.

Such decomposition coupled with surface roughening of coating 134 due to the spark discharge renders that surface oleophilic at each image point I directly opposite the tip of electrode 58. Preferably that coating is made quite thin, e.g. 0.0003 inch to minimize the voltage required to break down the material to render it ink receptive. Resultantly, when plate 130 is inked by roller 22*a* in press 10, ink adheres only to those transformed image points I on the plate surface. Areas of the plate not so imaged, corresponding to the background area of the original document to be printed, do not pick up ink from roll 22*a*. The inked image on the plate is then transferred by blanket cylinder 14 to the paper sheet P as in any conventional offset press.

Figure 4D:
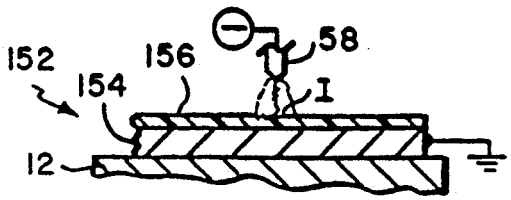

FIG. 4D illustrates a lithographic plate 152 suitable for indirect imaging and for wet printing. The plate 152 comprises a substrate 154 made of a suitable conductive metal such as aluminum or copper. Applied to the surface of substrate 154 is a layer 156 of phenolic resin, parylene, diazo-resin or other such material to which oil and rubber-based inks adhere readily. Suitable positive working, subtractive plates of this type are available from the Enco Division of American Hoechst Co. under that company's designation P-800.

When the coating 156 is subjected to a spark discharge from electrode 58, the image point I on the surface of layer 156 opposite the electrode tip 58*b* decomposes under the heat and becomes etched so that it readily accepts water. Actually, if layer 156 is thick enough, substrate 154 may simply be a separate flat electrode member disposed opposite the electrode 58. Accordingly, when the plate 152 is coated with water and ink by the rolls 26*b* and 22*a*, respectively, of press 10, water adheres to the image points I on plate 152 formed by the spark discharges from electrode 58. Ink, on the other hand, shuns those water-coated surface points on the plate corresponding to the background or non-printed areas of the original document and adheres only to the non-imaged areas of plate 152.

Figure 4E:
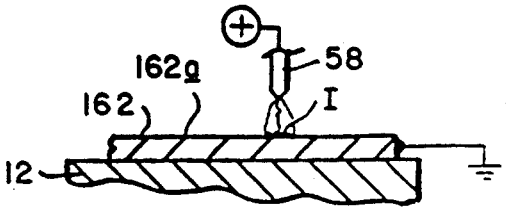

Another offset plate suitable for indirect writing and for use in a wet press is depicted in FIG. 4E. This plate, indicated at 162 in that figure, consists simply of a metal plate, for example, copper, zinc or stainless steel, having a clean and polished surface 162*a*. Metal surfaces such as this are normally oleophilic or ink-receptive due to surface tension. When the surface 162*a* is subjected to a spark discharge from electrode 58, the spark and ancillary corona field etch that surface creating small capillaries or fissures in the surface at the image point I opposite the electrode tip 58*b* which tend to be receptive to or wick up water. Therefore, during printing the image points I on plate 162, corresponding to the background or non-printed areas of the original document, receive water from roll 26*b* of press 10 and shun ink from the ink roll 22*a*. Thus ink adheres only to the areas of plate 162 that were not subjected to spark discharges from electrode 58 as described above and which correspond to the printed portions of the original document.

Figure 4F:
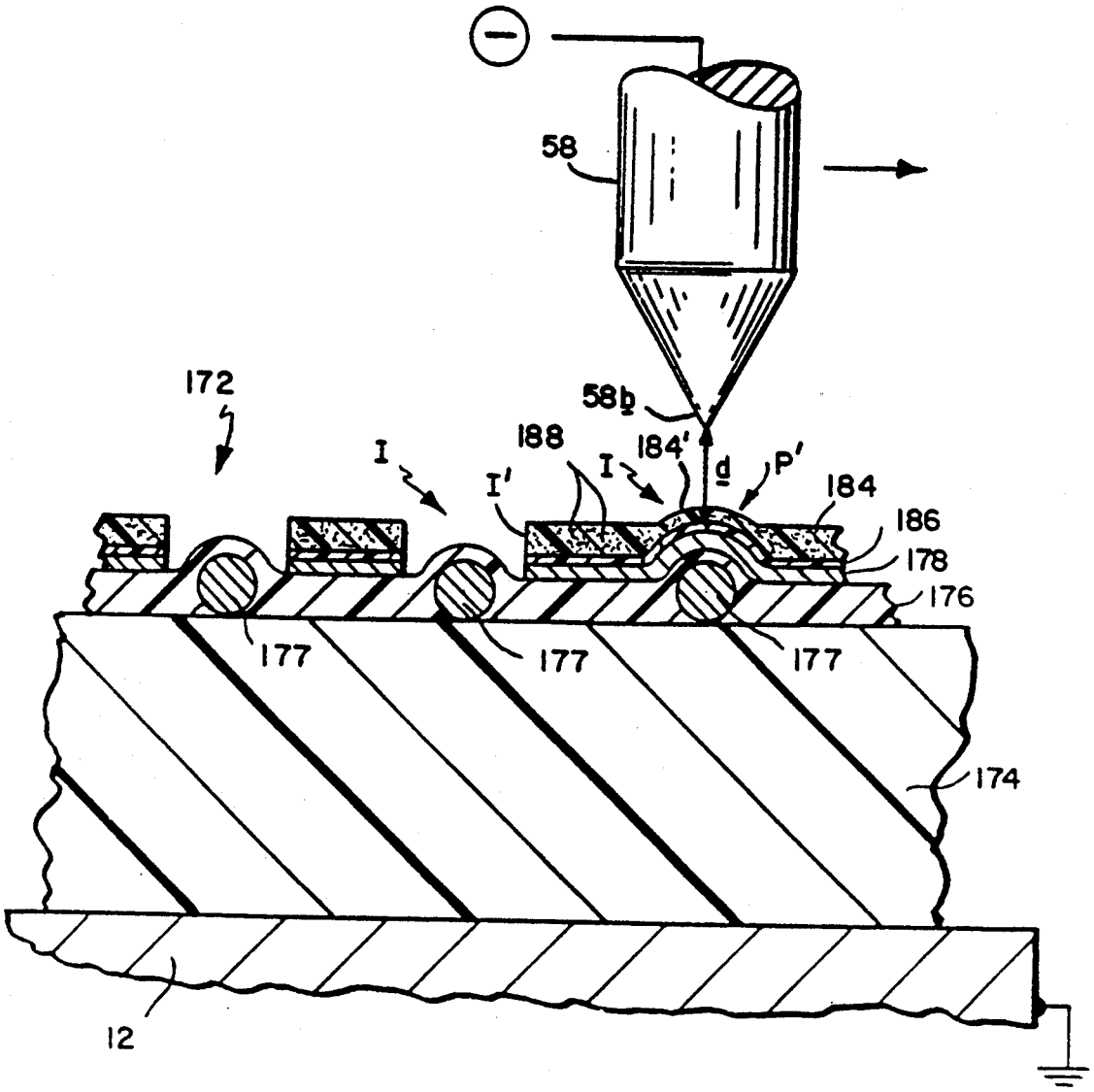

Refer now to FIG. 4F which illustrates still another plate embodiment 172 suitable for direct imaging and for use in an offset press without dampening. We have found that this novel plate 172 actually produces the best results of all of the plates described herein in terms of the quality and useful life of the image impressed on the plate.

Plate 172 comprises a base or substrate 174, a base coat or layer 176 containing pigment or particles 177, a thin conductive metal layer 178, an ink repellent silicone top or surface layer 184, and, if necessary, a primer layer 186 between layers 178 and 184.

1. Substrate 174

The material of substrate 174 should have mechanical strength, lack of extension (stretch) and heat -resistance. Polyester film meets all these requirements well and is readily available. Dupont's Mylar and ICI's Melinex are two commercially available films. Other films that can be used for substrate 174 are those based on polyimides (Dupont's Kapton) and polycarbonates (GE's Lexan). A preferred thickness is 0.005 inch, but thinner and thicker versions can be used effectively.

There is no requirement for an optically clear film or a smooth film surface (within reason). The use of pigmented films including films pigmented to the point of opacity are feasible for the substrate, providing mechanical properties are not lost.

2. Base Coat 176

An important feature of this layer is that it is strongly textured. In this case, "textured" means that the surface topology has numerous peaks and valleys. When this surface is coated with the thin metal layer 178, the projecting peaks create a surface that can be described as containing numerous tiny electrode tips (point source electrodes) to which the spark from the imaging electrode 58 can jump. This texture is conveniently created by the filler particles 177 included in the base coat, as will be described in detail hereinafter under the section entitled Filler Particles 177. Other requirements of base coat 176 include:

a) adhesion to the substrate 174;
b) metallizable using typical processes such as vapor deposition or sputtering and providing a surface to which the metal(s) will adhere strongly;
c) resistance to the components of offset printing inks and to the cleaning materials used with these inks;
d) heat resistance; and
e) flexibility equivalent to the substrate.

The chemistry of the base coat that can be used is wide ranging. Application can le from solvents or from water. Alternatively, 100% solids coatings such as characterize conventional UV and EB curable coating can be used. A number of curing methods (chemical reactions that create crosslinking of coating components) can be used to establish the performance properties desired of the coatings. Some of these are:

a) Thermoset Typical thermoset reactions are those as an aminoplast resin with hydroxyl sites of the primary coating resin. These reactions are greatly accelerated by creation of an acid environment and the use of heat.
b) Isocyanate Based One typical approach are two part urethanes in which an isocyanate component reacts with hydroxyl sites on one or more "backbone" resins often referred to as the "polyol" component. Typical polyols include polyethers, polyesters, an acrylics having two or more hydroxyl functional sites. Important modifying resins include hydroxyl functional vinyl resins and cellulose ester resins. The isocyanate component will have two or more isocyanate groups and is either monomeric or oligomeric. The reactions will proceed at ambient temperatures, but can be accelerated using heat and selected catalysts which include tin compounds and tertiary amines. The normal technique is to mix the isocynate functional component(s) with the polyol component(s) just prior to use. The reactions begin, but are slow enough at ambient temperatures to allow a "potlife" during which the coating can be applied. In another approach, the isocyanate is used in a "blocked" form in which the isocyanate component has been reacted with another component such as a phenol or a ketoxime to produce an inactive, metastable compound. This compound is designed for decomposition at elevated temperatures to liberate the active isocyanate component which then reacts to cure the coating, the reaction being accelerated by incorporation of appropriate catalysts in the coating formulation.
c) Aziridines The typical use is the crosslinking of waterborne coatings based on carboxyl functional resins. The carboxyl groups are incorporated into the resins to provide sites that form salts with water soluble amines, a reaction integral to the solubilizing or dispersing of the resin in water. The reaction proceeds at ambient temperatures after the water and solubilizing amine(s) have been evaporated upon deposition of the coating. The aziridines are added to the coating at the time of use and have a potlife governed by their rate of hydrolysis in water to produce inert by-products.
d) Epoxy Reactions The elevated temperatures cure of boron trifluoride complex catalyzed resins can be used, particularly for resins based on cycloaliphatic epoxy functional groups. Another reaction is based on UV exposure generated cationic catalysts for the reaction. Union Carbide's Cyracure system is a commercially available version.
e) Radiation Cures are usually free radical polymerizations of mixtures of monomeric and oligomeric acrylates and methacrylates. Free radicals to initiate the reaction are created by exposure of the coating to an electron beam or by a photoinitiation system incorporated into a coating to be cured by UV exposure. The choice of chemistry to be used will depend on the type of coating equipment to be used and environmental concerns rather than a limitation by required performance properties. A crosslinking reaction is also not an absolute requirement. For example, there are resins soluble in a limited range of solvents not including those typical of offset inks and their cleaners that can be used.

3. Filler Particles 177

The filler particles 177 used to create the important surface structure are chosen based on the following considerations:

a) the ability of a particle 177 of a given size to contribute to the surface structure of the base coat 176. This is dependent on the thickness of the coating to be deposited. This is illustrated for a 5 micron thick (0.0002 inch) coat 176 pigmented with particles 77 of spherical geometry that remain well dispersed throughout deposition and curing of the coat. Particles with diameters of 5 microns and less would not be expected to contribute greatly to the surface structure because they could be contained within the thickness of the coating. Larger particles, e.g. 10 microns in diameter, would make significant contributions because they could project 5 microns above the base coat 176 surface, creating high points that are twice the average thickness of that coat.
b) the geometry of the particles 177 is important. Equidimensional particles such as the spherical particles described above and depicted in FIG. 4F will contribute the same degree regardless of particle orientation within the base coat and are therefore preferred. Particles with one dimension much greater than the others, acicular types being one example, are not usually desirable. These particles will tend to orient themselves with their long dimensions parallel to the surface of the coating, creating low rounded ridges rather than the desirable distinct peaks. Particles that are platelets are also undesirable. These particles tend to orient themselves with their broad dimensions (faces) parallel to the coating surface, thereby creating low, broad, rounded mounds rather than desirable, distinct peaks.
c) the total particle content or density within the coating is a function of the image density to be encountered. For example, if the plate is to be imaged at 400 dots per centimeter or 160,000 dots per square centimeter, it would be desirable to have at least that many peaks (particles) present and positioned so that one occurs at each of the possible positions at which a dot may be created. For a coating 5 microns thick, with peaks produced by individual particles 177, this would correspond to a density of $3.2\times10^8$ particles/cubic centimeter (in the dried, cured base coat 176).

Particle sizes, geometries, and densities are readily available data for most filler particle candidates, but there are two important complications. Particle sizes are averages or mean valves that describe the distribution of sizes that are characteristic of a given powder or pigment as supplied. This means that both larger and smaller sizes than the average or mean are present and are significant contributors to particle size considerations. Also, there is always some degree of particle association present when particles are dispersed into a fluid medium, which usually increases during the application and curing of a coating. Resultantly, peaks are produced by groups of particles, as well as by individual particles.

Preferred filler particles 177 include the following:

a) amorphous silicas (via various commercial processes)
b) microcrystalline silicas
c) synthetic metal oxides (single and in multi-component mixtures)
d) metal powders (single metals, mixtures and alloys)
e) graphite (synthetic and natural)
f) carbon black (via various commercial processes)

Preferred particle sizes for the filler particles to be used is highly dependent on the thickness of the layer 176 to be deposited. For a 5 micron thick layer (preferred application), the preferred sizes fall into one of the following two ranges:

a) 10 +/−5 microns for particles 177 that act predominantly as individuals to create surface structure, and
b) 4 +/−2 microns for particles that act as groups (agglomerates) to create surface structure.

For both particle ranges, it should be understood that larger and smaller sizes will be present as part of a size distribution range, i.e. the values given are for the average or mean particle size.

The method of coating base layer 176 with the particles 177 dispersed therein onto the substrate 174 may be by any of the currently available commercial coating processes.

A preferred application of the base coat is as a layer 5 +/−2 microns thick. In practice, it is expected that base coats could range from as little as 2 microns to as much as 10 microns in thickness. Layers thicker than 10 microns are possible, and may be required to produce plates of high durability, but there would be considerable difficulty in texturing these thick coatings via the use of filler pigments.

Also, in some cases, the base coat 176 may not be required if the substrate 174 has the proper, and in a sense equivalent, properties. More particularly, the use for substrate 174 of films with surface textures (structures) created by mechanical means such as embossing rolls or by the use of filler pigments may have an important advantage in some applications provided they meet two conditions:

a) the films are metalizable with the deposited metal forming layer 178 having adequate adhesion; and
b) their film surface texture produces the important feature of the base coat described in detail above.

4. Thin Metal Layer 178

This layer 178 is important to formation of an image and must be uniformly present if uniform imaging of the plate is to occur. The image carrying (i.e. ink receptive) areas of the plate 172 are created when the spark discharge volatizes a portion of the thin metal layer 178. The size of the feature formed by a spark discharge from electrode tip **58*b*** of a given energy is a function of the amount of metal that is volatized. This is, in turn, a function of the amount of metal present and the energy required to volatize the metal used. An important modifier is the energy available from oxidation of the volatized metal (i.e. that can contribute to the volatizing process), an important partial process present when most metals are vaporized into a routine or ambient atmosphere.

The metal preferred for layer 178 is aluminum, which can be applied by the process of vacuum metallization (most commonly used) or sputtering to create a uniform layer 300 +/−100 Angstroms thick. Other suitable metals include chrome, copper and zinc. In general, any metal or metal mixture, including alloys, that can be deposited on base coat 176 can be made to work, a consideration since the sputtering process can then deposit mixtures, alloys, refractories, etc. Also, the thickness of the deposit is a variable that can be expanded outside the indicated range. That is, it is possible to image a plate through a 1000 Angstrom layer of metal, and to image layers less than 100 Angstroms thick. The use of thicker layers reduces the size of the image formed, which is desirable when resolution is to be improved by using smaller size images, points or dots.

5. Primer 186 (when required)

The primer layer 186 anchors the ink repellent silicone coating 184 to the thin metal layer 178. Effective primers include the following:

a) silanes (monomers and polymeric forms)
b. titanates
c) polyvinyl alcohols
d) polyimides and polyamide-imides Silanes and titanates are deposited from dilute solutions, typically 1–3% solids, while polyvinyl alcohols, polyimides, and polyamides-imides are deposited as thin films, typically 3 +/− 1 microns. The techniques for the use of these materials is well known in the art.

6. Ink Repellent Silicone Surface Layer 184

As pointed out in the background section of the application, the use of a coating such as this is not a new concept in offset printing plates. However, many of the variations that have been proposed previously involve a photosensitizing mechanism. The two general approaches have been to incorporate the photoresponse into a silicone coating formulation, or to coat silicone over a photosensitive layer. When the latter is done, photoexposure either results in firm anchorage of the silicon coating to the photosensitive layer so that it will remain after the developing process removes the unexposed silicon coating to create image areas (a positive working, subtractive plate) or the exposure destroys anchorage of the silicone coating to the photosensitive layer so that it is removed by "developing" to create image areas leaving the unexposed silicone coating in place (a negative working, subtractive plate). Other approaches to the use of silicone coatings can be described as modifications of zerographic processes that result in an image-carrying material being implanted on a silicone coating followed by curing to establish durable adhesion of the particles.

Plates marketed by IBM Corp. under the name Electroneg use a silicon coating as a protective surface layer. This coating is not formulated to release ink, but rather is removable to allow the plates to be used with dampening water applied.

The silicon coating here is preferably a mixture of two or more components, one of which will usually be a linear silicone polymer terminated at both ends with functional (chemically reactive) groups. Alternatively, in place of a linear difunctional silicone, a copolymer incorporating functionality into the polymer chain, or branched structures terminating with functional groups may be used. It is also possible to combine linear difunctional polymers with copolymers and/or branch polymers The second component will be a multifunctional monomeric or polymeric component reactive with the first component Additional components and types of functional groups present will be discussed for the coating chemistries that follow.

a) Condensation Cure Coatings are usually based on silanol (-Si-OH) terminated polydimethylsiloxane polymers (most commonly linear). The silanol group will condense with a number of multifunctional silanes. Some of the reactions are:

| Functional Group | Reaction | By product |
|---|---|---|
| Acetoxy | $-Si-OH + \underset{RCO-Si-}{\overset{O}{\parallel}}$ | $-Si-O-Si- + \underset{HOCR}{\overset{O}{\parallel}}$ |
| Alkoxy | $-Si-OH + RO-Si-$ | $-Si-O-Si- + HOR$ |
| Oxime | $-Si-OH + R_1R_2C{=}NO-Si-$ | $-SI-O-Si- + HON{=}CR_1R_2$ |

Catalysts such as tin salts or titanates can be used to accelerate the reaction. Use of low molecular weight groups such as $CH_3$— and $CH_3CH_2$— for $R_1$ and $R_2$ also help the reaction rate yielding volatile byproducts easily removed from the coating. The silanes can be difunctional, but trifunctional and tetrafunctional types are preferred.

Condensation cure coatings can also be based on a moisture cure approach. The functional groups of the type indicated above and others are subject to hydrolysis by water to liberate a silanol functional silane which can then condense with the silanol groups of the base polymer. A particularly favored approach is to use acetoxy functional silanes, because the byproduct, acetic acid, contributes to an acidic environment favorable for the condensation reaction. A catalyst can be added to promote the condensation when neutral byproducts are produced by hydrolysis of the silane.

Silanol groups will also react with polymethyl hydrosiloxanes and polymethylhydrosiloxane copolymers when catalyzed with a number of metal salt catalysts such as dibutyltindiacetate. The general reaction is:

$$-Si-OH + H-Si\ (catalyst) \rightarrow Si-O-Si- + H_2$$

This is a preferred reaction because of the requirement for a catalyst. The silanol terminated polydimethylsiloxane polymer is blended with a polydimethylsiloxane second component to produce a coating that can be stored and which is catalyzed just prior to use. Catalyzed, the coating has a potlife of several hours at ambient temperatures, but cures rapidly at elevated temperatures such as 300° F. Silanes, preferably acyloxy functional, with an appropriate second functional group (carboxy phoshonated, and glycidoxy are examples) can be added to increase coating adhesion. A working example follows.

b) Addition Cure Coatings are based on the hydrosilylation reaction; the addition of Si—H to a double bond catalyzed by a platinum group metal complex. The general reaction is:

$$-Si-H + CH_2{=}CH-Si-(catalyst) \rightarrow -Si-CH_2CH_2-Si-$$

Coatings are usually formulated as a two part system composed of a vinyl functional base polymer (or polymer blend) to which a catalyst such as a chloroplantinic acid complex has been added along with a reaction modifier(s) when appropriate (cyclic vinyl-methylsiloxanes are typical modifiers), and a second part that is usually a polymethylhydrosiloxane polymer or copolymer. The two parts are combined just prior to use to yield a coating with a potlife of several hours at ambient temperatures that will cure rapidly at elevated temperatures (300° F., for example). Typical base polymers are linear vinyldimethyl terminated polydimethylsiloxanes and dimethylsiloxane-vinylmethylsiloxane copolymers. A working example follows.

c) Radiation Cure Coatings can be divided into two approaches. For U.V. curable coatings, a cationic mechanism is preferred because the cure is not inhibited by oxygen and can be accelerated by post U.V. exposure application of heat. Silicone polymers for this approach utilize cycloaliphatic epoxy functional groups. For electron beam curable coatings, a free radical cure mechanism is used, for requires a high level of inerting to achieve an adequate cure. Silicone polymers for this approach utilize acrylate functional groups, and can be crosslinked effectively by multifunctional acrylate monomers.

Preferred base polymers for the surface coatings 184 discussed are based on the coating approach to be used. When a solvent based coating is formulated, preferred polymers are medium molecular weight, difunctional polydimethylsiloxanes, or difunctional polydimethylsiloxane copolymers with dimethyl-siloxane composing 80% or more of the total polymer. Preferred molecular weights ranged from 70,000 to 150,000. When a 100% solids coating is to be applied, lower molecular weights are desirable, ranging from 10,000 to 30,000. Higher molecular weight polymers can be added to improve coating properties, but will comprise less than 20% of the total coating. When additional cure or condensation cure coatings are to be formulated, preferred second components to react with silanol or vinyl functional groups are polymethylhydrosiloxane or a polymethylhydrosiloxane polymer with dimethylsiloxane.

Preferably, selected filler pigments 188 are incorporated into the surface layer 184 to support the imaging process as shown in FIG. 4F. The useful pigment materials are diverse, including:

a) aluminum powders
b) molybdenum disulfide powders
c) synthetic metal oxides
d) silicon carbide powders
e) graphite f) carbon black Preferred particle sizes for these materials are small, having average or mean particle sizes considerably less than the thickness of the applied coating (as dried and cured). For example, when an 8 micron thick coating 184 is to be applied, preferred sizes are less than 5 microns and are preferably, 3 microns or less. For thinner coatings, preferred particle sizes are decreased accordingly. Particle 188 geometries are not an important consideration. It is desirable to have all the particles present enclosed by the coating 184 because particle surfaces projecting at the coating surface have the potential to decrease the ink release properties of the coating. Total pigment content should be 20% or less of the dried, cured coating 184 and preferably, less than 10% of the coating. An aluminum powder supplied by Consolidated Astronautics as 3 micron sized particles has been found to be satisfactory. Contributions to the imaging process are believed to be conductive ions that support the spark (arc) from electrode 58 during its brief existence, and considerable energy release from the highly exothermic oxidation that is also believed to occur, the liberated energy contributing to decomposition and volatilization of material in the region of the image forming on the plate.

The ink repellent silicone surface coating 184 may be applied by any of the available coating processes. One consideration not uncommon to coating processes in general, is to produce a highly uniform, smooth, level coating. When this is achieved, the peaks that are part of the structure of the base coat will project well int the silicone layer. The tips of these peaks will be thin points in the silicone layer, as shown at 184' in FIG. 4F, which means the insulating effect of the silicone will be lowest at these points contributing to a spark jumping to these points. These projections of the base coat 176 peaks due to particles 177 therein are depicted at P in FIG. 4F.

Working Examples of Ink Repellent Silicone Coatings

1. Commercial Condensation cure coating supplied by Dow Corning:

| Component | Type | Parts |
|---|---|---|
| Syl-Off 294 | Base Coating | 40 |
| VM & P Naptha | Solvent | 110 |
| Methyl Ethyl Ketone | Solvent | 50 |
| Aluminum Powder | Filler Pigment | 1 |
| | Blend/Disperse Powder/Then Add: | |
| Syl-Off 297 | Acetoxy Functional Silane | 1.6 |
| | Blend/Then Add: | |
| XY-176 Catalyst | Dibutyltindiacetate | 1 |

-continued

| Component | Type | Parts |
|---|---|---|
| | Blend/Then Use: | |
| Apply with a #10 Wire Wound Rod<br>Cure at 300° F. for 1 minute | | |

2. Commercial addition cure coating supplied by Down Corning:

| Component | Type | Parts |
|---|---|---|
| Syl-Off 7600 | Base Coating | 100 |
| VM-P Naptha | Solvent | 80 |
| Methyl Ethyl Ketone | Solvent | 40 |
| Aluminum Powder | Filler Pigment | 7.5 |
| | Blend/Disperse Powder/Then Add: | |
| Syl-Off 7601 | Crosslinker | 4.8 |
| | Blend/Then Use: | |
| Apply with a #4 Wire Wound Rod<br>Cure at 300° F. for 1 minute | | |

This coating can also be applied as a 100% solids coating (same formula without solvents) via offset gravure and cured using the same conditions.

3. Lab coating formulations illustrating condensation cure and addition cure coatings are given in the following Table 1. Identify of indicated components are given in the following Table 2. All can be applied by coating with wire wound rods and cured in a convection oven set at 300° F. using a 1 minute dwell time. Coating 4 can be applied as a 100% solids coating and cured under the same conditions.

TABLE 1

| Formulation: Parts Basis | Condensation Cure Coatings | | | Addition Cure Coatings | | | |
|---|---|---|---|---|---|---|---|
| Components | 1 | 2 | 3 | 4 | 5 | 6 | 7 |
| PS - 345.5 | 20 | 20 | — | — | — | — | — |
| PS - 347.5 | — | — | 20 | — | — | — | — |
| PS - 424 | — | — | — | — | 50 | — | — |
| PS - 442 | — | — | — | 64 | — | — | — |
| PS - 445 | — | — | — | — | — | 50 | — |
| PS - 447.6 | — | — | — | — | — | — | 50 |
| PS - 120 | 2 | — | 2 | 2 | 4 | 1 | 1 |
| PS - 123 | — | 6 | — | — | — | — | — |
| T - 2160 | — | — | — | 1 | 1 | — | — |
| Sly-OFF 297 | 2 | 2 | 2 | — | — | — | — |
| Dibutyltindiacetate | 1.2 | 1.2 | 1.2 | — | — | — | — |
| PC - 085 | — | — | — | 0.05 | 0.05 | 0.05 | 0.1 |
| VM & P Naptha | 118 | 114 | 148 | 64 | 55 | 100 | 133 |
| Methyl Ethyl Ketone | 60 | 60 | 75 | — | 55 | 50 | 67 |
| Aluminum Powder | 2 | 2 | 2 | 4 | 3 | 3 | 3 |

TABLE 2

| Component | Type | Molecular Weight | Supplier |
|---|---|---|---|
| PS - 345.5 | Silanol Terminated Polydimethylsiloxane | 77000 | Petrarch Systems |
| PS - 347.5 | Silanol Terminated Polydimethylsiloxane | 110000 | Petrarch Systems |
| PS - 424 | Dimethylsiloxane - Vinymethylsiloxane Copolymer 7.5% Vinylmethyl Comonomer | | Petrarch Systems |
| PS - 442 | Vimyldimethyl Terminated Polydimethylsiloxane | 17000 | Petrarch Systems |
| PS - 445 | Vimyldimethyl Terminated Polydimethylsiloxane | 63000 | Petrarch Systems |
| PS - 447.6 | Vimyldimethyl Terminated Polydimethylsiloxane | 118000 | Petrarch Systems |
| PS - 120 | Polymethylhydrosiloxane | 2270 | Petrarch Systems |
| PS - 123 | (30-35%) Mehylhydro - (65-70%) Dimethylsiloxane Copolymer | 2000-2100 | Petrarch Systems |
| T - 2160 | 1,3,5,7 Tetravinyltetramethylcyclotetrasiloxane | | Petrarch Systems |
| Syl-Off 297 | Acetoxy Functional Silane | | Dow Corning |
| PC - 085 | Platinum - Cyclvinylmethylsiloxane Complex | | Petrarch Systems<br>Petrarch Systems |

When plate 172 is subjected to a writing operation as described above, electrode 58 is pulsed, preferably negatively, at each image point I on the surface of the plate. Each such pulse creates a spark discharge between the electrode tip 58*b* and the plate, and more particularly across the small gap d between tip 58*b* and the metallic underlayer 178 at the location of a particle 177 in the base coat 176, where the repellent outer coat 184 is thinnest. This localizing of the discharge allows close control over the shape of each dot and also over dot placement to maximize image accuracy. The spark discharge etches or erodes away the ink repellent outer layer 184 (including its primer layer 186, if present) and the metallic underlayer 178 at the point I directly opposite the electrode tip 58*b* thereby creating a well I' at that image point which exposes the underlying oleophilic surface of base coat or layer 176. The pulses to electrode 58 should be very short, e.g. 0.5 microseconds to avoid arc "fingering" along layer 178 and consequent melting of that layer around point I. The total thickness of layers 178, 182 and 184, i.e. the depth of well I', should not be so large relative to the width of the image point I that the well I' will not accept conventional offset inks and allow those inks to offset to the blanket cylinder 14 when printing.

Plate 172 is used in press 10 with the press being operated in its dry printing mode. The ink from ink roller 22*a* will adhere to the plate only to the image points I thereby creating an inked image on the plate that is transferred via blanket roller 14 to the paper sheet P carried on cylinder 16.

Instead of providing a separate metallic underlayer 178 in the plate as in FIG. 4F, it is also feasible to use a conductive plastic film for the conductive layer. A suitable conductive material for layer 184 should have a volume resistivity of 100 ohm centimeters or less, Dupont's Kapton film being one example.

To facilitate spark discharge to the plate, the base coat 176 may also be made conductive by inclusion of a conductive pigment such as one of the preferred base coat pigments identified above.

Also, instead of producing peaks P by particles 177 in the base coat, the substrate 174 may be a film with a textured surface that forms those peaks. Polycarbonate films with such surfaces are available from General Electric Co.

Figure 4G:
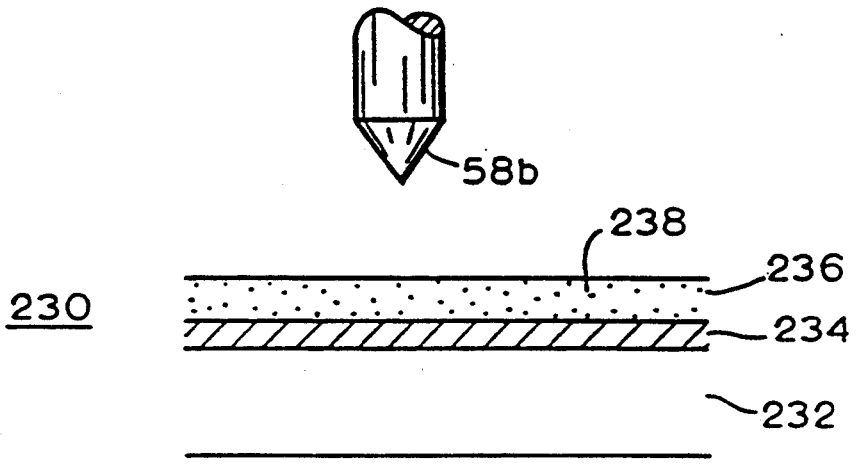

Another lithographic plate suitable for direct imaging in a press without dampening is illustrated in FIG. 4G. Reference numeral 230 denotes generally a plate comprising a heat-resistant, ink-receptive substrate 232, a thin conductive metal layer 234, and an ink-repellent surface layer 236 containing image-support material 238, as described below. In operation, plate 230 is written on or imaged by pulsing electrode 58 at each image point I on the surface of the plate. Each such pulse creates a spark discharge between the electrode tip 58*b* and the point on the plate directly opposite, destroying the portions of both the ink-repellent outer layer 236 and thin-metal layer 234 that lie in the path of the spark, thereby exposing ink-receptive substrate 232. Because thin-metal layer 234 is grounded and ink-receptive substrate 232- resists the effects of heat, only the thin-metal layer 234 and ink-repellent surface 236 are volatized by the spark discharge.

Ink-receptive substrate 232 is preferably a plastic film. Suitable materials include polyester films such as those marketed under the tradenames MYLAR (E. I. duPont de Nemours) or MELINEX (ICI). Thin-metal layer 234 is preferably aluminum deposited as a layer from 200 to 500 angstroms thick. Other materials suitable for thin metal layer 234 and ink-receptive substrate 232 are described above in connection with corresponding layers 178 and 174, respectively, in FIG. 4F.

Image-support material 238 is most advantageously dispersed in silicone, of the type described in connection with surface layer 184 in FIG. 4F. If necessary, a primer coat (not depicted in FIG. 4G) may be added between thin-metal layer 234 and surface layer 184 to provide anchoring between these layers.

The function of image-support material 238 is to promote straight-line travel of the spark as it emerges from electrode tip 58*b*. Producing this behavior reliably has proven one of the most difficult aspects of spark-discharge plate design, because even slight lateral migration of the spark path produces unacceptably distorted images.

The path followed by an emitted spark is not actually random, but rather is determined by the direction of the electric field existing between the imaging electrode and the surface of the plate. This field is created when an imaging pulse is first directed to the electrode. A spark forms only after the medium between the electrode and the plate surface has ionized due to the energy of the field, a process which requires a measurable amount of time. Ionization of the medium provides the conductive pathway along which the spark travels. Once the spark is formed, it remains in existence for the remaining duration of the image pulse. If the plate surface is not conductive, it, too, must be broken down by the electric field, which may result in the passage of additional time prior to spark formation. During the cumulative duration of these delays, the electric field may become distorted due to the changes occurring in the medium and/or on the plate surface, resulting in an irregular spark path.

Although one might assume that particles composed of a highly conductive material would serve as a useful spark-guiding filler material, we have found that this is not the case; we have also found that the distribution of such particles does not materially deter the spark from following an apparently random path. In a random dispersion of particles, there can be no guarantee that the particle directly opposite the electrode tip will also be closest (in terms of linear distance) to the electrode tip; nor is distance always determinative, since a dense area of particles can provide a stronger attraction for the spark than a single particle lying closer to the electrode (so long as the additional distance to the dense area is not too great). A non-random distribution of particles can result in regions of pure silicone that contain no particles; if such a region occurs directly opposite the electrode when a pulse is delivered, the spark will probably deviate from a straight-line path toward a more conductive silicone region.

We have experimented with such conductive materials as graphite, carbon black, and metal powders; these can be used to pigment silicone coatings to render such coatings conductive, and are often cited in the prior art. Carbon blacks and graphites are available as particles which are sufficiently small to avoid undesirable creation of a surface texture, and can be used to produce coatings that remain stable as dispersions. We have found, however, that when a quantity of one or more of these materials sufficient to affect the imaging process is introduced into an oleophobic coating, reduction of oleophobic character can occur, with the consequence that unwanted ink will adhere to the non-image portions of the plate during printing. Carbon blacks and graphites can also react adversely with some of the catalysts normally used for thermally cured silicone coatings.

Conductive metal powders typically are not available in usefully small particle sizes, and tend to be excessively dense and lacking in surface area to permit formation of stable dispersions. Although metal powders are successfully used in a large number of paints and coatings characterized by high viscosity and solids content, such materials yield compositions that are far too thick for use as imageable plate coatings.

Yet even if these undesirable characteristics of conductive particles could be overcome, our experiments suggest that such particles would contribute to imaging only in a limited fashion. Instead, we have found that certain types of materials, including many semiconductors, support accurate imaging by promoting straight-line spark discharge. These materials frequently have structures that allow polarization by a strong electric field, and also contain conduction bands of sufficiently low energy to be rendered accessible by polarization; alternatively, a suitable material may respond to a strong electric field by populating available conduction bands to a much greater extent than would be obtained in the absence of the field. Such materials undergo a pronounced increase in conductivity, relative to that of ground-state or low-voltage conditions, when exposed to an electric field of at least 1,000 volts. We herein refer to such compounds as "conditionally conductive".

One group of useful compounds includes metal oxides whose crystals contain two or more metal ions of different oxidation states bound to the appropriate number of oxide ions to preserve electrical neutrality. The metal ion species may derive from the same or different metals. A second type of compound comprises metal oxide compounds, of the same or different oxidation states, that polarize significantly in the presence of a strong electric field. A third, related category of compound includes a variety of "doped" metal-oxide materials, in which relatively small, non-stoichiometric amounts of a second metal are present. In a fourth type of compound, a metal atom or ion is bound to a relatively electronegative species such as sulfur, nitrogen, arsenic, phosphorus, antimony, bismuth, carbon, or silicon. Another type comprises high-$T_c$ (i.e. 70°-100° K.) superconductor materials and related precursors. We have also identified a number of conditionally conductive compounds that do not fall within any of the foregoing categories.

Without being bound to any particular theory or mechanism, we believe that the observed tendency of useful image-support compounds to promote straight-line spark discharge is due primarily to crystal and electronic structure. Low-energy electron migration pathways within the crystal, induced or enhanced by the strong electric field centered at the electrode tip during pulsing, channel electrons into the underlying thin-metal layer. Due to geometric configuration, the point on the plate surface immediately opposite the electrode tip will be exposed to the electric field most directly. Conditionally conductive particles in the path of this field will tend to become more conductive as a result of polarization or conduction-band population, strengthening the field gradient between the electrode tip and the plate surface. This phenomenon occurs prior to arcing of the spark. With the altered crystals providing a current-flow conduit of lower resistance than that of the unaffected crystals and surrounding oleophobic medium, the spark is encouraged to follow the path of least resistance through these particles to the plate, and thereby follow a straight-line path. Imaging accuracy might be further enhanced by localized heating of the altered crystals as the spark begins to form, which may further increase their conductivities.

This effect contrasts markedly to that generated by particles whose conductivities are not affected by an electric field. Such particles do not offer a preferred path for conduction, and straight-line spark travel will be promoted only at those points where the most favorable distribution of particles occurs opposite the electrode tip. Using the conditionally conductive particles of the present invention, we have found that a random distribution of particles assures the greatest degree of gradient strengthening, because distortions due to particle position are statistically minimized.

For a compound to exhibit the necessary response to a strong electric field, its crystalline form apparently must possess a structure and electronic configuration that results either in (i) susceptibility to polarization by a strong electric field, resulting in increased accessibility of available conduction bands through lowering of the energetic levels of such bands, or (ii) increased population of existing conduction bands without energetic modification. It should be noted that polarizability, in and of itself, in no way guarantees that a material will be conditionally conductive, since polarization can reduce the accessibility of a conduction band as well as improve it. As we will show, conduction bands that are entirely inaccessible in the absence of a strong field—rendering the compound a relatively poor conductor—can nonetheless serve to produce a low-energy pathway for electron migration, and produce good spark-guiding properties.

Polarizability is a characteristic determined by crystal structure, and the electron affinities of the various atoms and ions therein. Atoms and ions in a polarizable crystal shift position in response to an electric field, allowing the crystal to take on the charge distribution of the field and thereby augment the overall field gradient. In the context of the present invention, altering the symmetry of the crystal results in enhanced conductivity and/or degradation of barriers to conductivity.

The field-induced availability of conduction bands within the crystal can arise from any of a number of physical attributes:

a. The crystal lattice allows a physical feature, such as a plane or chain of ions, to extend across a crystal grain, thereby providing a low-energy pathway for electron migration.
b. The crystal lattice contains metal and non-metal atoms or ions placed such that metal d orbital and non-metal p (or $\pi_p$) orbital overlap occurs.
c. The potential energy of the crystal lattice is not appreciably elevated by delocalization of one or more d-orbital electrons from the metal atom or ion into a conduction band.
d. Antiferromagnetic "pinning" of outer-shell electrons, which under ordinary conditions completely precludes virtually all conductivity, is overcome by field-induced polarization.

1. Types of Compounds

Single-Metal Oxides

The following oxides of a single metal, in which the metal ion is present in one or more oxidation states, promote imaging (where formulae are enclosed in parenthesis, the first metal is in the +2 state, the second in the +3 state):

$Fe_3O_4$ ($FeFe_2O_4$)
Gamma $Fe_2O_3$
$Co_3O_4$ ($CoCo_2O_4$)
$Mn_3O_4$ ($MnMn_2O_4$)
$Pb_3O_4$ ($Pb_2PbO_4$, +2/+4)
$PbO_2$
$CrO_2$
ZnO
$MnO_2$
$MoO_2$
$NbO_2$
SnO
$SnO_2$
$Cu_2O$
CuO
TiO
$Ti_2O_3$
$V_2O_3$
$VO_2$
$WO_2$
$WO_3$
$In_2O_3$ The +2/+3 oxidation state compounds, $Fe_3O_4$ and $Co_3O_4$ are probably conductive due to a rapid valence oscillation between the metal sites in the crystal lattice, which results in the transfer of positive charge from cation to cation; this effect is enhanced in the presence of an electric field, resulting in the formation of a low-energy pathway for electron migration. See, e.g., W. Kingery, H. Bowen and D. Uhlmann, *Introduction to Ceramics* (1976) at 899-902.

Of the foregoing compounds, $Fe_3O_4$ and $Co_3O_4$ exert the strongest spark-guiding effect. Both exhibit symmetric, isometric crystal structures. Although $Mn_3O_4$ might be expected to exhibit similar valence oscillation due to comparable electromotive characteristics, we have found that this compound does not function as well as $Fe_3O_4$ and $Co_3O_4$ $Mn_3O_4$ is known to have a less symmetrical tetragonal crystal structure. It therefore appears that crystal symmetry plays a significant part in determining the relevance of valence oscillation to spark-guiding performance, presumably as a result of smaller conformational strain in the symmetrical crystal structures due to valence oscillation. Strain produces energy loss, resulting in less efficient conduction and, apparently, less field responsiveness.

We have also found that valence oscillation contributes to spark-guiding activity only where the transition energy between the two oxidation states is minimal. For practical purposes, this seems to require both ions to be of the same metal; otherwise, the benefits of enhanced conductivity are balanced or outweighed by the electromotive energy needed to cause oscillation. Thus, we observed that even isometric crystal structures do not result in advantageous valence oscillation in the following mixed-metal compounds: $Co(Cr,Al)_2O_4$, $CuCr_2O_4$:MnO:$MoO_3$ (probably isometric), $Fe(Fe,Cr)_2O_4$:$SiO_2$, $ZnFe_2O_4$, $Zn,Fe(Fe,Cr)_2O_4$ and $Zn,Mn,Fe(Fe,Mn)_2O_4$.

By way of comparison, the hexagonal crystal structure of alpha $Fe_2O_3$ apparently does not place metal and oxygen ions in positions that allow conductive pathways to develop, in contrast to the isometric structure of gamma $Fe_2O_3$. The former compound produces virtually no spark-guiding effect, while the latter exhibits good performance. Furthermore, although $Cu_2O$, a material with a symmetric isometric crystal structure, performs adequately, better results are obtained with monoclinic CuO.

In other compounds of this group, conduction bands arise from orbital overlap. The induced conductivities of titanium, vanadium, niobium, molybdenum, tungsten, chromium and manganese compounds appear to derive primarily from overlap between metal d orbitals and oxygen p or $\pi_p$ orbitals, and ready availability of easily dislodged d-orbital electrons. Although the crystal lattice must be compatible-with the electronic configuration of the metal ion after it has surrendered one or more d-orbital electrons to the conduction band, a wide variety of crystal structures appear to satisfy this criterion.

Thus, compounds of Vanadium(V) (such as $V_2O_5$) and those of Titanium(IV) (such as $TiO_2$) do not perform well due to the absence of available d-orbital electrons. Alpha $Cr_2O_3$, which has a hexagonal crystal structure, also performs poorly due to the incompatibility of its crystal system with d-electron removal. Other compounds that we have found not to be useful include $CeO_2$, $Gd_2O_3$, MnO, $MoO_3$, $Nb_2O_5$, NiO, $Sm_2O_3$ and $Y_2O_3$.

ZnO, despite its hexagonal crystal structure, is known from its piezoelectric properties to be polarizable. The compound exhibits advantageous spark-guiding properties; this is due to defects or holes in its crystal lattice that are caused by missing oxygen atoms, and which result in the presence of zinc atoms or ions having a lower oxidation state. Because d-orbital electrons are tightly bound, zinc is limited to a +2 oxidation state; the presence of neutral zinc, with two easily dislodged valence electrons, provides a source of conductivity within the crystal that enhances the effect of polarization. In other words, while polarization probably lowers the energy of conduction bands within the crystal, thereby rendering them more accessible, conditional conductivity is significantly improved by the addition of available charge carriers to populate the conduction bands.

In the case of the copper compounds, conductivity probably arises from the presence of non-stoichiometric amounts of lower-oxidation-state copper within the crystal lattice, providing s-orbital and d-orbital electrons that can be dislodged with relative ease. Thus, the crystals of the copper(II) compounds may contain trace amounts of copper(I) or neutral copper, while defects in copper(I) crystals can be filled by neutral copper atoms or copper(II) ions; in the latter case, the neutral copper is presumably the primary contributor to the observed conductivity.

Mixed-Metal Oxides

The following mixed-metal oxide compounds have also been found useful as image-support materials (oxidation states are +2/+3 unless otherwise indicated):

$CoCr_2O_4$
$CuCr_2O_4$
$MnCr_2O_4$
$NiCr_2O_4$
$LaCrO_3$ (+3/+3)
$Fe,Mn(Fe,Mn)_2O_4$
$Fe,Mn(Fe,Mn)_2O_4$:CuO
$Cu(Fe,Cr)_2O_4$ $CuFe_2O_4$
$CoFe_2O_4$
$NiFe_2O_4$
$MgFe_2O_4$

Where two metals are separated by a comma, the crystal structure contains both metals in both oxidation states. The usefulness of these compounds as image-support material probably arises from crystal defects; their conductivities are thus similar to those of the copper and zinc compounds discussed above.

Due to their varying positions in the electrochemical series, the different metal ions in these compounds do not undergo valence exchange. Without valence oscillation, polarization of the isometric crystal structures found in most of these compounds does not guarantee the formation of accessible conduction bands. Accordingly, polarization, while necessary for conditional conductivity, is not always sufficient.

Indeed, some compounds appear to exhibit good spark-guiding characteristics solely as a result of polarization, without ever becoming conductive. $BaTiO_3$, $CaTiO_3$ and $PbTiO_3$ exhibit perovskite crystal structures, which are known for their ferroelectric properties; perovskites tend to polarize significantly in the presence of a strong electric field. Nonetheless, these compounds are ordinarily non-conductive. The ability of these compounds to contribute to spark-guiding therefore demonstrates the degree to which polarization can produce limited spark-guiding properties even in the absence of conductivity. We have also tested other titanium-based compounds which do not have perovskite structures, such as $Bi_2Ti_4O_{11}$, $CoTiO_3$, $(Ti,Ni,Sb)O_2$, $(Ti,Ni,Nb)O_2$, $(Ti,Cr,Nb)O_2$, $(Ti,Cr,Sb)O_2$, $(Ti,Mn,Sb)O_2$, with decidedly poor results.

When susceptibility to polarization is combined with inherent conductivity, spark-guiding performance increases. The worthwhile results obtained with $Fe_3O_4$ and $CrO_2$ probably derive from polarizability in combination with availability of d-orbital electrons.

Doped Oxide Compounds

Semiconductors are frequently "doped", or impregnated with small amounts of material that enhances conductivity (e.g., by lowering the average energy necessary to promote a valence electron into a conduction band). One common dopant material is gallium, used alone or in combination with another metal. Selectively altering the conductivity level of a given semiconductor can result in enhanced imaging performance; addition of the dopant can be viewed as deliberate creation of conductivity-enhancing crystal defects, as discussed above with respect to zinc and copper compounds.

Metal-oxide compounds can also be doped with other oxide compounds. For example, we previously noted that conductivities associated with certain zinc and copper oxide compounds may derive from the presence of small amounts of the neutral atom within the crystal lattice, providing a source of loosely bound valence electrons. Suitably chosen dopants can be used to sequester oxygen atoms, thereby reducing the metal ion to the ground state. For example, adding aluminum to ZnO results in formation of $Al_2O_3$ and liberation of free zinc atoms within the crystal lattice. However, excessive addition of aluminum results in production of too much $Al_2O_3$; since this compound is less conductive than ZnO, the result is a crystal whose conductivity is less than that of undoped ZnO.

We have also found that $SnO_2$ performs well when uniformly combined with relatively small amounts of $Sb_2O_3$, and that $In_2O_3$ performs well when uniformly combined with relatively small amounts of $SnO_2$. We suspect that the dopants in these mixtures create defects in a polarizable crystal lattice, providing a source of charge carriers to populate accessible conduction bands.

Commercial sources of doped oxide compounds include the Stanostat line of conductive pigments, manufactured by Keeling & Walker, Ltd., United Kingdom, and marketed by Magnesium Electron, Inc., Flemngton, N.J.

It is also possible to avoid using the pure crystals by depositing the metal-oxide compounds as a thin layer on a carrier. BY using a hollow core, one can reduce the density of each particle without significant diminution of its sparkguiding characteristics, and more easily create uniform silicon dispersions. Suitable examples include a line of anitomony-doped tin oxide compounds marketed by E. I. duPont de Nemours & Co., Deepwater, N.J. under the tradename Zelec ECP. The Zelec ECP materials are produced by application of the doped oxide as a thin, dense layer on a variety of inert powders; available inert cores include mica, titanium dioxide and silica spheres (which may be solid or hollow).

Chalocogenides and Other Group VI Compounds

Chalcogenides are compounds containing at least one positively charged metal, and in which the electronegative species is at least one Group VI element other than oxygen. We have found that a number of chalocogenides are useful as image-support pigments. It appears that the observed conductivities of such compounds arises from overlap of metal d orbitals with d, p and/or $\pi_p$ orbitals of the Group VI element, and possibly from crystal structures that place metal atoms or ions in sufficiently close proximity to allow for metal-metal electronic interactions.

We have also obtained successful results with a number of other Group VI compounds that do not fit the above definition of a chalcogenide. These include compounds that comprise at least one Group VI element (preferably sulfur, selenium and/or tellurium) combined with at least one non-metal species or both metal and non-metal species; in many cases, the Group VI species may be less electronegative than the other species. Indeed, throughout our experimentation, the only Group VI compounds with which we did not achieve success were $WS_2$ and $MoS_2$, which have dominant planar structures that are not efficient conductors.

The following compounds provide advantageous imaging support:

$TiSe_2$
$TiS_2$
$TiTe_2$
$NbSe_2$
$NbS_{1.75}$
$NbTe_2$
CrSe
$Cr_2S_3$
$Cr_2Te_3$
$MoSe_2$
$MoS_2$
$MoTe_2$
$WSe_2$ $WS_2$
$WTe_2$
MnSe
$MnSe_2$
MnS
$MnTe_2$
CoS
NiS
NiTe
CuS
CuTe
ZnSe
ZnS
ZnTe
SnS
SnTe
PbSe
PbS
PbTe
$Sb_2Se_3$
$Sb_2S_3$
$Sb_2Te_3$
$Bi_2S_3$
$Bi_2Te_3$

A number of considerations attend introduction of chalcogenide compounds into spark-imaged lithographic plates. Otherwise inert selenium, tellurium and sulfide materials can, under the influence of a high-voltage spark, undergo reactions that liberate toxic or otherwise objectionable products. Such emissions can be removed from the imaging platform by any number of currently available vacuuming or other fume-collection techniques.

Undesirable chalcogenide derivatives can also be produced as a consequence of the curing procedure employed with respect to surface layer 236. For example, polyhydrosiloxane materials, which are used in addition-cure and some condensation-cure reactions, can react with compounds based on sulfur, selenium or tellurium to produce unwanted hydrogen sulfide, hydrogen selenide or hydrogen telluride. Furthermore, sulfur, selenium and tellurium are all strong poisons for the chloroplatinic acid complexes used in addition-cure reactions.

We approach problems associated with interactions between surface layer 236 and the image-support pigment by judicious choice of the ink-repellent layer. We have found, for example, that the "moisture-cure" reactions mentioned above are not adversely affected by the presence of chalcogenide pigments.

Metal Nitrides crystalline forms. The latter tend to be electrically conductive and chemically inert, and therefore of interest as imagesupport pigments. We have found the following compounds to be useful:

TiN
ZrN
VN
NbN
TaN
$Cr_2N$
$MoN/Mo_2N$ (mixture)
$Mn_xN$ (where x=2 to 4)
$Fe_xN$ (where x=2 to 4)

Metal Arsenides

A number of semiconductive arsenides are known, and we would expect many of these to promote imaging. Because arsenides are toxic, precautions in handling and use of these compounds must be observed.

Metal Phosphides

Many transition-metal phosphides are electrically conductive, stable and inert, and are therefore of interest as imagesupport pigments. It must be borne in mind, however, that many phosphides are hydrolytically unstable, producing highly toxic phosphines upon exposure to moisture. Accordingly, appropriate reaction and use conditions must be maintained.

The following phosphides were found to encourage straightline spark discharge:

CrP
$MnP/Mn_2P$ (mixture)
$Zn_3P_2$

Antimonides and Bismuthides

The following metal antimonides and bismuthides were found to enhance imaging accuracy:

$Mg_3Sb_2$
$Mg_3Bi_2$
NiSb
NiBi
SnSb

Carbon Compounds

Like nitrides, the carbides form both ionic and interstitial compounds; the latter have physical characteristics similar to the interstitial nitrides, and are therefore of interest. As discussed above, elemental carbon, while conductive, is not conditionally conductive and therefore does not materially assist in the imaging process.

We have found the following interstitial carbide compounds useful:

TiC
ZrC
VC
$Nb_2C$
NbC
$Ta_2C$
TaC
$Cr_3C_2$
$Cr_7C_3$
$Cr_{26}C_6$
$Mo_2C$
MoC
$W_2C$
WC

Silicon Compounds

Silicides are also found as ionic and interstitial compounds, the latter of interest. Elemental silicon, available as a stable solid and known for its numerous semiconductor applications, was also found to enhance imaging accuracy.

The following interstitial silicides were found to promote imaging:

$Ti_5Si_3$
$TiSi_2$
$ZrSi_2$
$V_3Si$
$VSi_2$
$NbSi_2$
$Ta_5Si_3$
$TaSi_2$
$Cr_3Si$
$CrSi_2$
$MoSi_2$
$W_5Si_3$ $WSi_2$
$MnSi_2$
$FeSi_2$
$CoSi_2$
$NiSi_2$
Al/Si mixed phases The final silicide, denoted as Al/Si mixed phases, denotes a mixture of crystal phases possessing some structural attributes. This type of mixed phase material is sometimes referred to as an "alloy" because of the range of constituent proportions that are possible.

Boron Compounds

Borides, which can be stoichiometrically and structurally complex, include a number of conductive species that promote straight-line spark discharge. Amorphous elemental boron is also useful, but does not perform as well as elemental silicon.

The following compounds were found to assist the imaging process:

$MgB_{12}$
$CaB_6$
$SrB_6$
$LaB_6$
$SmB_6$
$TiB_2$
$ZrB_2$
$ZrB_{12}$
VB
$VB_2$
CrB
$CrB_2$
WB
$W_2B_5$
$AlB_2$
$AlB_{12}$

Superconductors and Related Precursors

The following high-$T_c$ superconductor materials and related precursors have also been found useful as image-support materials:

$Ba_2CuO_3$
$Ba_2Ca_3Cu_4O_9$
$Bi_2Sr_2CaCu_2O_{8+x}$
$La_2CuO_4$
$YBa_2Cu_3O_{7-x}$

In the foregoing formulae, x denotes oxygen atoms added to or subtracted from the compound as part of the processing necessary to achieve superconductivity. To the extent that accurate values for x have been obtained at all, they may vary depending on the manufacturer. However, it appears generally settled that x ranges from 0.1 to 0.5.

It is likely that the same features giving rise to superconductive properties also promote induced conductivity in the high-voltage spark environment. Structurally, the foregoing compounds tend to be similar to the perovskites. However, some have theorized that their superconductive properties derive from the presence of physical features, such as planes and chains, that span individual crystal grains and provide low-energy pathways for electron migration between adjacent planes and/or chains. For example, it is known that the structure of copper oxide superconductors contains electronically active planes of copper and oxygen that are sandwiched between other layers; the other layers act both as spacers and as charge reservoirs.

Frequently, compounds that are closely related to superconductors show no conductivity whatsoever due to antiferromagnetic "pinning" of outer-shell electrons. However, if their crystal structures are sufficiently susceptible to polarization, a strong electric field may unpin these electrons, greatly enhancing the conductivity of the affected crystal grains as compared to those outside the field (and thereby promoting straight-line spark travel).

Research into high-T ©superconductivity is still in an early stage, but all of the materials fitting this category that we have tested have exhibited positive imaging characteristics. We would expect similarly useful results from other such materials as these become available.

2. Resistor Effects

Some of the foregoing materials, to varying degrees, tend to inhibit the ablative action of the spark as it strikes the plate surface; for reasons explained below, we refer to this phenomenon as the "resistor effect". The observed result is production not only of a smaller image spot than would otherwise be expected for an imaging pulse having a given output profile, but also incomplete removal of the plate material within the ablation boundary.

For example, compounds such as borides have high melting points and resist thermal decomposition. These compounds (and, to a lesser degree, some of the carbides and nitrides) act as natural resistors, increasing in temperature without disintegration as current passes through individual particles, and thereby dissipating part of the arc energy that would otherwise be available for volatilization of the coating.

Accordingly, when the resistance of a susceptible filler pigment dissipates part of the arc energy, the result is a smaller ablated area. Thus, depending on the image-support pigment used and its concentration within surface layer 236, it may be necessary to augment the peak voltage of the imaging pulse to obtain a surface feature of desired area. Alternatively, it may be possible to lower the conductive capacity of the individual crystals by reducing their sizes; however, obtaining meaningful size reductions for many compounds that exhibit the resistor effect may be excessively expensive using current production techniques.

With other compounds, a second type of resistor effect has been observed; however, instead of reducing the efficiency of ablation, this second effect actually contributes to the imaging process. It involves the propensity of some relatively fragile compounds to undergo sharp, immediate increases in resistivity upon exposure to significant heat, thereby ensuring their early destruction by the arc. We believe that as the arc begins to form, the pigment particles in its path undergo rapid resistive heating and degrade to a non-conductive form almost instantly, before the arc is exhausted. For the remainder of its duration, then, the arc energy ablates only the surrounding overlayer material 236 and thin-metal layer 234, without unnecessary dissipation of energy within the pigment. Whatever the precise mechanism, it appears clear that the total energy necessary to degrade the pigment particles is ultimately less than that necessary to ablate a comparable volume of overlayer material.

A number of inorganic materials are known to be susceptible to thermally induced changes in resistivity. While the current-carrying capacities of semiconductors generally increase upon exposure to heat, some materials exhibit the opposite effect above a critical temperature, undergoing irreversible change to a more highly resistive chemical form. One example is $MnO_2$, which exhibits this latter, helpful resistor effect.

3. In-Situ Properties

As stated above, the use of metal powders and other traditional conductive pigments is not viewed as a useful approach to enhancing imaging accuracy. This conclusion derives primarily from practical constraints that attend construction of useful dry plates. Spark accuracy is not a concern when imaging plates that present a bare metal surface, such as those discussed above in connection with FIGS. 4A and 4B. In these cases, the strength of the field gradient between the electrode and the plate surface suffices to limit lateral migration of the spark, presumably due to rapid diminution of the gradient in all directions deviating from dead normal.

This is not the case n a typical dry-plate construction, where the silicone (or other) overlayer plays an insulating role., reducing the effective strength of the field gradient. Nonetheless, such constructions can be made to exhibit behavior similar to that of a metal-surface plate by dispersion of large amounts of conductive pigment within the silicone overlayer. If the pigment concentration is sufficient, a significant degree of particle-to-particle contact is achieved, and the silicone material becomes a minor impurity that does not exert appreciable an insulating effect.

Unfortunately, high pigment concentrations also degrade the ink repellency of the, overlayer, and can also interfere with spark ablation due to the resistor effect discussed above. Using ordinary conductive pigments, we have found that concentrations as high as 80% by weight of the coating can be necessary to achieve acceptable spark guiding effects; these proportions clearly reduce ink-release properties and the size of the image spot. The pigment concentration required to produce particle-to-particle contact grows as particle size is decreased.

Our conditionally conductive pigment materials dispense with the need to use highly conductive coatings to promote imaging accuracy; this permits us to reduce the pigment loading to levels below that which would otherwise be necessary for good spark-guiding performance if conductivity were the only concern. On average, proportions in the range of 10–20% by weight of the coating have been found to suffice, although our work suggests that as little as 5% by weight is sufficient in the case of low-density, highly effective fillers, while as much as 75% by weight can be successfully tolerated in the case of high-density fillers that are less effective. The optimum amount of pigment will vary with the material chosen, the type of coating, its thickness, the method of application and the desired plate resolution. However, this amount is readily determined by a practitioner skilled in the art with a minimum of experimentation. Particle size remains important: although particle-to-particle contact appears unnecessary, the dispersed particle mass must still be capable of conduction in the aggregate, and conductivity decreases as particles become more widely spaced. Particle sizes around 1 micron have been used advantageously.

A further benefit resulting from use of metal compounds (as contrasted with pure metals) as image-support materials arises from their typically lower densities; this characteristic allows the preparation of dispersions of higher stability in the environment of the present invention, which contemplates a low viscosity, low solids content coating for surface layer 236. The following comparison of the specific gravities of several metals and certain oxides thereof illustrates this feature, which also holds true for many non-oxide compounds:

| Material | Specific Gravity |
|---|---|
| Co | 8.9 |
| CoO | 6.45 |
| $Co_3O_4$ | 6.7 |
| Cu | 8.92 |
| $Cu_2O$ | 6.0 |
| CuO | 6.4 |
| Zn | 7.14 |
| ZnO | 5.606 |
| W | 19.35 |
| $WO_2$ | 12.11 |
| $WO_3$ | 7.16 |

When preparing particle dispersions in material such as silicone that will subsequently be cured into a polymer network, it is useful to recognize various process constraints that can affect performance of the finished plate. For example, particle agglomeration may take place if the coating is not cured soon after dispersion, resulting in non-uniform particle distribution and reduced imaging accuracy. Furthermore, the pigment particles themselves act as tiny obstructions when the coating is cured, interrupting formation of the polymer network; if particle concentrations are large relative to the solids content of the coating, sufficient cross-linking to ensure adequate coating strength may not develop.

One way of circumventing these concerns is to utilize pigment compounds that become integral constituents of the polymer network as it develops. Aluminum/silicon mixed-phase compounds, for example, are known to interact with and bind to silicone functional groups; see, e.g., Japanese patent 1-258308 (published Oct. 16, 1989). Silicon atoms on the surfaces of Al/Si particles can be hydroxylated or hydrogenated, and subsequently bond to functional polyorganosiloxane groups during the curing process. Thus, using a condensation- or moisture-cure mechanism, a hydroxylated silicon atom on the particle surface can bond to a silanol functional group on one of the polyorganosiloxane chains; however, the surface contains other, as-yet-unbound hydroxylated silicon atoms that are free to bond with other polyorganosiloxane chains. Not only does this process firmly anchor the particles within the polymer matrix, but also augments the extent of cross-linking rather than interrupting it.

The Al/Si particles can also be used with other types of silicone coating systems. The condensation reaction just discussed can be transformed into another elimination reaction having a different leaving group by combining hydrogen-bearing and silanol polyorganosiloxane chains and a tin catalyst. With this type of curing system silanol groups remain on the primary long-chain polyorganosiloxane component (as well as the Al/Si particles), but the cross-linking component contains distributed hydrogen (rather than silanol) substituents. As the mixture is cured, silanol groups combine with hydrosiloxane groups to form Si—O—Si bonds with the release of hydrogen, $H_2$. The Al/Si particles bond to the cross-linking component in the same manner as do the long-chain molecules, thereby becoming part of the developing matrix. This elimination reaction occurs quickly, and is particularly suitable for web-coating applications.

As we have noted, addition-cure systems based on hydrosilylation involve reaction of unsaturated (e.g., vinyl) functional groups with hydrosiloxane units. Even in these addition-cure systems, the silanol-bearing surfaces of the Al/Si particles still react with the methylhydrosiloxane groups of the cross-linking component according to the elimination reaction discussed above. Once again, the Al/Si particles become integrally associated with the developing polymer matrix.

Although the discussion has focused on Al/Si particles, other compounds or mixtures capable of bonding with reactive groups in surface layer 236 would also be suitable.

All of the lithographic plates described above can be imaged on press 10 or imaged off press by means of the spark discharge imaging apparatus described above. The described plate constructions in toto provide both direct and indirect writing capabilities and they should suit the needs of printers who wish to make copies on both wet and dry offset presses with a variety of conventional inks. In all cases, no subsequent chemical processing is required to develop or fix the images on the plates. The coaction and cooperation of the plates and the imaging apparatus described above thus provide, for the first time, the potential for a fully automated printing facility which can print copies in black and white or in color in long or short runs in a minimum amount of time and with a minimum amount of effort.

It will thus be seen that the objects set forth above, among those made apparent from the preceding description, are efficiently attained and, since certain changes may be made in carrying out the above process, in the described products, and in the constructions set forth without departing from the scope of the invention, it is intended that all matter contained in the above description or shown in the accompanying drawings shall be interpreted as illustrative and not a limiting sense.

It is also to be understood that the following claims are intended to cover all of the generic and specific features of the invention herein described.

What is claimed is:

1. A lithographic plate that is transformable so as to change the affinity of said plate for ink, said plate being a layered structure including a substrate, a conductive layer and a coating, said coating containing a dispersion of particles that comprise at least one doped metal-oxide compound.

2. The plate of claim 1 wherein the particles comprise $In_2O_3$ doped with $SnO_2$.

3. The plate of claim 1 wherein the particles comprise $SnO_2$ doped with $Sb_2O_3$.

4. The plate of claim 1 wherein the compound is a doped zinc oxide compound.

5. A lithographic plate that is transformable so as to change the affinity of said plate for ink, said plate being a layered structure including a substrate, a conductive layer and a coating, said coating containing a dispersion of particles that comprise at least one compound selected from the group consisting of metal nitrides, metal arsenides, metal phosphides, metal antimonides, metal bismuthides, metal carbides, metal silicides, metal borides, or elemental silicon or an alloy thereof.

6. The plate of claim 5 wherein the compound includes at least one metal arsenide.

7. The plate of claim 5 wherein the compound includes at least one metal phosphide.

8. The plate of claim 7 wherein the metal phosphide is an interstitial compound.

9. The plate of claim 5 wherein the compound includes at least one metal antimonide.

10. The plate of claim 5 wherein the compound includes at least one metal bismuthide.

11. The plate of claim 5 wherein the compound includes at least one metal carbide.

12. The plate of claim 11 wherein the metal carbide is an interstitial compound.

13. The plate of claim 5 wherein the compound includes at least one metal silicide.

14. The plate of claim 13 wherein the metal silicide is an interstitial compound.

15. The plate of claim 5 wherein the compound includes elemental silicon or an alloy thereof.

16. The plate of claim 5 wherein the compound includes at least one metal boride.

17. The plate of claim 16 wherein the metal boride is an interstitial compound.

18. The plate of claim 17 wherein the boride is a hexaboride.

19. The plate of claim 17 wherein the boride is a dodecaboride.

20. The plate of claim 5 wherein the compound includes at least one metal nitride.

21. The plate of claim 20 wherein the metal nitride is an interstitial compound.

22. A lithographic plate that is transformable so as to change the affinity of said plate for ink, said plate being a layered structure including a substrate, a conductive layer and a coating, said coating containing a dispersion of particles that comprise a doped, conditionally conductive material deposited on an inert core.

23. A method of imaging a lithographic plate, the method comprising the steps of:

a. providing a lithographic plate having a printing surface and including a substrate, a conductive layer and a coating, said coating containing a dispersion of particles consisting essentially of at least one crystalline conditional conductor whose conductivity is enhanced by the presence of an electric field;

b. spacing from the printing surface at least one discharge source, each of which includes a writing head comprising an electrode, each writing head being oriented opposite the printing surface; and c. removing said coating and conductive layer to reveal said substrate, and to thereby change the affinity of said printing surface for said liquid, by exposing the printing surface to a strong electric field at selected points, said exposures producing discharges substantially perpendicular to the printing surface at said points.

24. The method of claim 23 wherein the electric field interacts with the particles to cause substantially straight-line travel of said discharge from said writing head to said printing surface.

25. The method of claim 23 and including the additional step of altering, in order to vary the sizes of image spots produced by said discharges, a characteristic of the discharge selected from the group consisting of voltage, current, time duration and number of said discharges at any particular point.

26. The method of claim 23 further comprising the step of mounting the plate, prior to the spacing and exposing steps, to a plate cylinder of a lithographic press having at least one plate cylinder.

* * * * *